US005690165A

United States Patent [19]

Roth et al.

[11] Patent Number: 5,690,165

[45] Date of Patent: Nov. 25, 1997

[54] VENTILATION DEVICE FOR A SPACE ZONE

[75] Inventors: Hans-Werner Roth, Tamm; Andreas Böllinger; Gerd-Eugen Schaal, both of Stuttgart; Claus Händel, Bönnigheim, all of Germany

[73] Assignee: LTG Lufttechnische GmbH, Stuttgart, Germany

[21] Appl. No.: 495,494

[22] PCT Filed: Jan. 29, 1994

[86] PCT No.: PCT/EP94/00256

§ 371 Date: Jul. 27, 1995

§ 102(e) Date: Jul. 27, 1995

[87] PCT Pub. No.: WO94/18506

PCT Pub. Date: Aug. 18, 1994

[30] Foreign Application Priority Data

Feb. 2, 1993 [DE] Germany ..... 43 02 855.1
Apr. 3, 1993 [DE] Germany ..... 43 10 959.4

[51] Int. Cl.[6] ..... F24F 1/00

[52] U.S. Cl. ..... 165/54; 454/228; 454/230; 454/233; 454/236; 454/338; 92/34

[58] Field of Search ..... 165/54; 454/228, 454/230, 233, 236, 338; 92/34

[56] References Cited

U.S. PATENT DOCUMENTS

| | | | |
|---|---|---|---|
| 472,187 | 4/1892 | Brand | 92/34 |
| 584,154 | 6/1897 | Dunn, Sr. | 92/34 |
| 2,830,675 | 4/1958 | Drager | 454/338 |
| 2,839,157 | 6/1958 | Schuster | 454/338 |
| 2,888,870 | 6/1959 | Drager | 454/338 |
| 2,991,763 | 7/1961 | Marette | 92/34 |
| 3,804,364 | 4/1974 | De Lepeleire | 92/34 |
| 4,232,211 | 11/1980 | Hill | 165/43 |
| 4,918,935 | 4/1990 | Trent | 62/93 |
| 4,952,283 | 8/1990 | Besik | 165/54 |
| 5,016,856 | 5/1991 | Tartaglino | 92/34 |

FOREIGN PATENT DOCUMENTS

| | | | |
|---|---|---|---|
| 147982 | 3/1902 | Germany | 92/34 |
| 4216387 | 6/1993 | Germany | 454/228 |
| 4202970 | 8/1993 | Germany | 454/228 |
| 0256127 | 11/1986 | Japan | 454/233 |
| 62-5030 | 1/1987 | Japan | 454/338 |
| WO92/18814 | 10/1992 | WIPO . | |

OTHER PUBLICATIONS

Patent Abstract for JP 3249383 published Jul. 11, 1991, based on JP 90004970 applied for Feb. 28, 1990.

*Primary Examiner*—John K. Ford
*Attorney, Agent, or Firm*—Anderson, Kill & Olick, P.C.

[57] ABSTRACT

The invention relates to a ventilation device. Provision is made that the air propulsion plant (20) conveys at least a portion of the air in an air circulating mode by means of at least one variable volume chamber (6) in a pulsating manner at a very low frequency, with the chamber being connected to the room (2) by at least one air passage (21).

34 Claims, 17 Drawing Sheets

VENTILATION DEVICE FOR A SPACE ZONE

Figure 1:
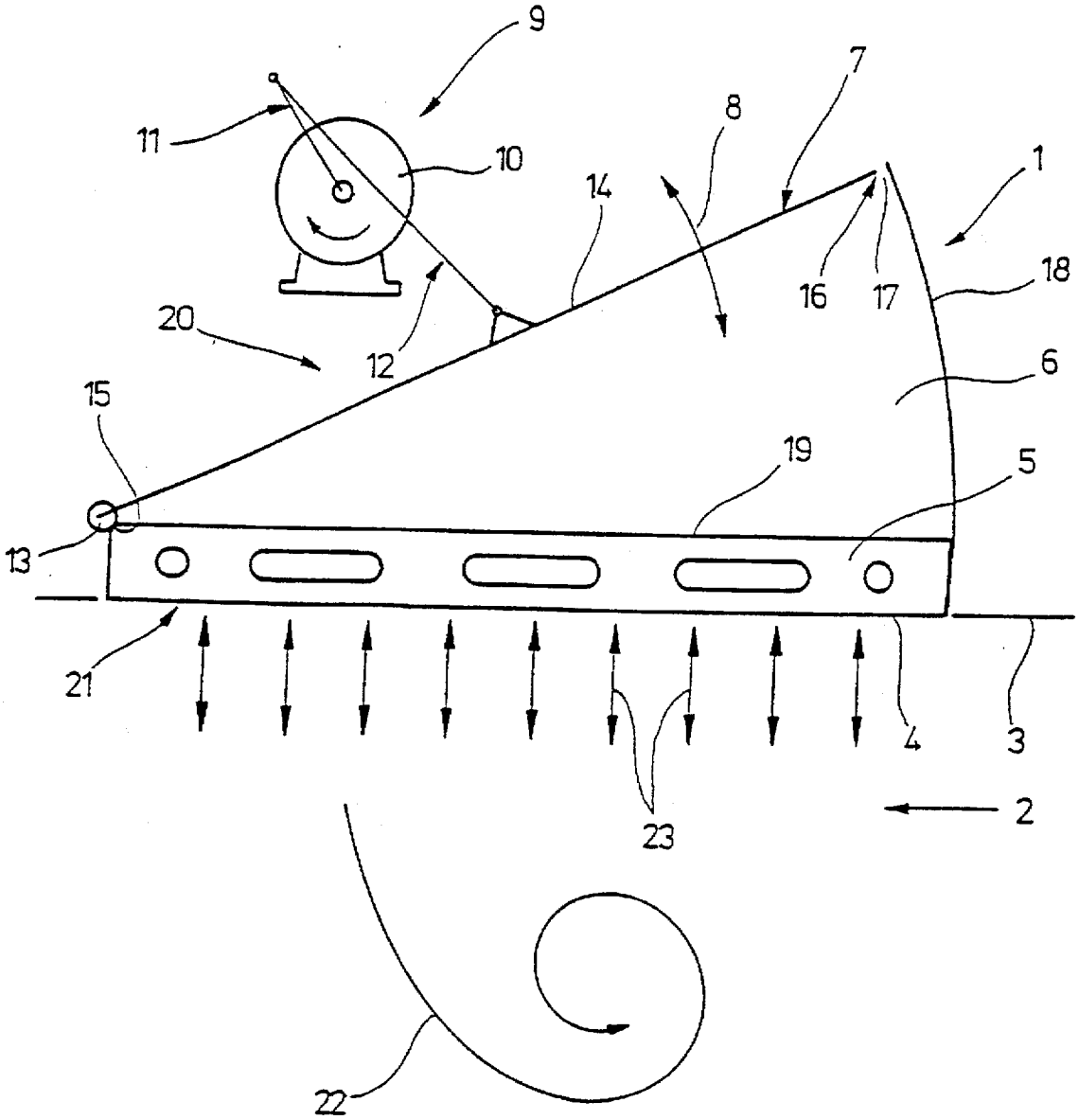

The invention relates to a ventilation device.

The increasing demand exists for ventilation devices. This applies in particular in the context of compact devices. They serve preferably for the thermodynamic treatment of ambient air of one or more spaces axes, in particular of an individual room or a space zone of such room/individual room. Such apparatus is employed by preference in office buildings and hotels. The advantage of such apparatus resides in the simple retrofitting of the rooms because in the case of an air treatment for, example, for heating or cooling purposes, it is merely necessary to provide an electricity and water connection to the extent that a mere air circulation operation takes place.

The known space ventilation devices of conventional construction comprise a fan which sucks in the air of the space and feeds it, for example to a heat exchanger. The air heated or cooled by the heat exchanger is then returned to the space due to the propelling action of the fan. A disadvantage is a relatively high noise level of the fan. Although motor noise can be damped substantially, if the motor is located in the air flow, the motor noise is unavoidably radiated as airborne sound, for example, in the case of compact compressor drums and axial ventilators with external rotor motors. Accordingly, the component contributed to the overall noise of the fan by the motor noise can only be reduced by the selection of a relatively silent, low vibration motor. Air flow noise generated by the impeller blades of the fan are always present. They can, however, be simply reduced by lowering the rotational speed. However, that results in an oversized fan. This causes the frequency spectrum to shift into a lower frequency region whereby the overall sensible noise level is slightly reduced. However, this causes a reduction of the efficiency of the motor because it operates far outside its designed range. Due to the required excess power of the motor, its construction size, its price and its heat output are also increased. Noise reduction in this manner can therefore, be effected only within narrow limits.

A further possibility of the airborne noise reduction lies in the use of silencers on the suction and pressure sides of the fans. This, however, excludes providing of a favorably priced compact device for one space axis or a plurality of space axes.

Accordingly, an object of the invention is to provide a ventilation device of the type as set forth in the introduction, which is of a simple construction, operates reliably, is favorably prices and, in particular, operates at low noise levels. In particular, a long life expectancy of 10,000–20,000 operating hours should also be attained.

This object is achieved according to the present invention by providing a ventilation installation, wherein the air propulsion plant conveys at least part of the air conveyed in a circulatory and pulse-wise fashion by means of at least one chamber the volume of which can be changed and which is connected to the space zone or a room by at least one air passage. This causes at least part of the conveyed air to be sucked in from the room by enlarging the volume of the chamber and to be returned back into the room again by reduction of the volume of the chamber. During the suction and/or the return movement, the air passes through the air passage. Surprisingly, it was found that the air suction and the subsequent expulsion of the air does not result in a "short circuit" even if the chamber is connected with the room only by a single air passage. Does not result in a "short circuit" means that the same air volume is not continuously sucked in and expelled again. This is possible due to the pulsating conveyance of the air, because the expulsion is effected with such an expulsion impulse that the expelled air is released as a vortex and penetrates into the space. During the subsequent air intake, new ambient air can, therefore, rush in. If, in accordance with a further embodiment of the invention, the ventilation device comprises air treatment means, for example, a heat exchanger, it will only be necessary to provide a cold and/or hot water connection and an electricity supply connection for such installation. The ventilation device according to the invention is, therefore, particularly suitable for retrofitting if, for example, the thermal load of a room has changed. The ventilation device according to the invention, as mentioned before, serves for ventilating a room or a particular space zone of such room. When, in what follows, reference is made to a room, this may naturally also refer to a portion of such room, i.e., the aforesaid space zone. If reference is made to a "space zone" this may also indicate a reference to a complete room. What is said above applies, of course, also to the claims.

The device may be such that no air treatment means is provided, that is the ventilation device according to the invention serves merely to supply the space zone or the room with conveyed air, with at least part of this conveyed air being conveyed in an air circulation mode, that is air is withdrawn from the space zone (by enlarging the chamber volume) and subsequently again (by reduction of the volume) is expelled into the room. It is possible for this procedure to take place exclusively, that is that a purely circulatory operation is provided for. However, it is also conceivable for a mixed operation to be provided, that is a portion of the conveyed air is conveyed in the circulatory mode and a different part is conveyed in a fresh-air or primary air mode, i.e., this air portion is introduced into the chamber in a suitable manner and is expelled into the space zone by a reduction of the chamber volume. A purely primary respectively fresh-air operating mode is also feasible. Such operating mode will be referred to within the course of this application whenever disproportionately little air is sucked in from the space zone, when thus the feeding of primary or fresh-air predominates substantially.

In particularly the air passage forms both an air suction passage and an air expulsion passage, that is a single air passage takes care of both functions. Accordingly there is provided a compact construction, i.e., a high calorific output per unit volume.

Thus, it is advantageous to generate, during the expulsion of the air by means of the air propulsion means vortices having at least a pulse energy sufficiently high as to become separated and to penetrate into the room. Thereby, by means of the air propulsion plant, during expulsion of the air, pulse-like flow of sufficient energy content is generated so that the flow, as it has already been mentioned, is separated and, therefore, is not sucked in again.

The volume change of the chamber is effected by drive means which preferably operates at a frequency selectable within the range of 0.1 to 30, in particular 0.1 to 5 cycles per second. This low frequency operation has been found to be acoustically particularly favorable since it lies below the audible threshold.

According to a further development of the inventive concept, provision is made for an air-treatment apparatus, as discussed above, to be provided in the air passage. This air-treatment apparatus may, for example take the form of the previously mentioned heat exchanger. However, it is also possible that a means is provided to serve as an air-treatment apparatus, which modifies the air humidity. Alternatively, it is also possible to employ a material transformation means, for example, a catalyst which influences the chemical composition of the conveyed air. This above-mentioned list is not all inclusive, but other known and not herein mentioned air-treatment apparatus may be employed. It is also possible to employ combinations of different air-treatment apparatuses.

When in the following discussion "heat exchangers" are referred to (this applies both to the introductory part of the specification as well as to the description of the figures), this is not intended to be in a limiting sense but rather refers to all kinds of possible air-treatment means. Instead of the heat exchanger referred to, it is also possible to employ a different air-treatment apparatus or combination of different air-treatment apparatuses. In addition, it is also possible that whatever, in the course of this application, reference is made to a heat exchanger or to an air-treatment apparatus, no such means is employed at all, that is no air-treatment apparatus is provided in the air passage, and the ventilation device according to the invention, merely serves for the conveyance of air or gas without, however, simultaneously treating the air and/or the gas.

Preferably, the air passage is kept as short as possible. In particular, it may merely take the form of an aperture followed by a heat exchanger. Thereby the actual air passage length is approximately confined to the passage through the heat exchanger.

Preferably, a piston element is provided in the chamber of the ventilation device. The volume change is effected by the displacement of the piston element.

The piston element may according to one embodiment of the invention take the form of a translationally movable piston. Alternatively, however, it is also possible to design the piston element as a displacement element which, in the manner of a flap, is pivotal about an axis. The pivotal movement of the displacement element causes the chamber volume to be enlarged or reduced. The walls of the chamber are so shaped that they are adapted to the arcuate trajectory of the displacement element. Since the piston element is subjected to quite appreciable acceleration forces, it has preferably a panel-like design and thereby a light construction.

In order to adjust the conveyed air volume per unit of time, the frequency of movement of the piston element and/or the stroke thereof may be variable and thereby adjustable to a desired value. In addition, or alternatively it is also possible for the magnitude of the pivoting angle of the displacement element to be varied and thereby designed to be adjusted to a selectable value.

The base area of the chamber adjoining the heat exchanger may be larger than the base area of the heat exchanger. In such a case, it is advantageous for the air aperture of the heat exchanger, with regard to the larger adjoining base area of the chamber, to be offset in the direction of the pivoting axis of the displacement element. With such a design, a particularly favorable separation of the vortex of the expelled air is achieved.

If the displacement element, in its position where its movement is reversed at the end of the expulsion phase, directly adjoins the heat exchanger, the "dead space" is particularly small. Dead space or dead volume defines the space which does not participate in the volume change. This comprises in particular the interior of the heat exchanger, a residual space in the chamber and, where applicable, a portion of the air passage provided between the heat exchanger and the suction or expulsion aperture, for example, a "neck" of an air guide means.

More particularly, the principle applies that the dead space in comparison with the maximum volume of the chamber is smaller, in particular considerably smaller.

For a trouble-free performance it is not a disadvantage when the piston element is spaced from the wall of the chamber by a gap. Although this results in leakage losses, these are insignificant as long as the free opening surface area of the air passage connected to the room is much greater than the cross-section of the gap. The formation of the gap provides for a low noise operation because of the absence of friction between the components.

The pivoting angle of the displacement element which functions in the manner of a flap is preferably in the range of 20°to 180°.

As already mentioned above, the air passage, or the aperture may comprise an air guide means, in particular a slotted outlet provided with air guide means. With these means, the expulsion direction of the air can be adjusted.

In particular, it is provided that the ventilation device is installed at or in the ceiling and/or the walls of the room to be ventilated. On the other hand, a design is also conceivable wherein the ventilation device is accommodated in the floor region, for example, in a hollow floor of the room. In order to adjust the cooling or heating output, it is particularly simple to be able to make provision for the control or adjustment of the frequency, the stroke or the pivoting angle of the drive means. The higher is the frequency, and/or the greater is the stroke length and/or the greater is the pivoting angle, the larger will be the air throughput and thereby the cooling or heating output.

The drive means for the piston element is more particularly provided by a motor (electric motor), preferably a geared motor with an excentric device. The excentric device engages the piston element and thereby provides for the intermittently linear or intermittently pivotal movement.

The motor may, for example, take the form of a direct current motor. This offers the advantage that an electric means for controlling the rotational speed can be provided, which permits regulation or control of the rotational speed in a particularly simple manner.

However, alternatively it is also possible for the drive means to be formed as a linear stroke magnetic or rotary magnetic drive. A magnetic field is generated by means of an electrical current, which moves an anchor to and from, this movement being transferred to the piston element. In the case of employing a pivotal displacement element, the rotary magnetic drive is advantageous.

The piston element can be associated with a return means. In that case, the drive means only serves the purpose of moving the piston element into its one end position. It is then moved from this end position by the return means to the other end position. This may optionally be supported by the drive means. The return means preferably comprises a return spring. In addition, or in the alternative, it is also possible to so mount the piston element that its return movement is effected or supported by gravity forces.

A particularly high efficiency is attainable if the piston element is moved with its resonance frequency or the resonance frequency of the system composed of the return device and the piston element and (for noise reasons) is not limited in its movement by any mechanical stop means.

The ventilation installation may be of "double acting" design. For that purpose, the two sides of the piston element are each associated with an air passage leading into the room. When the piston element is moved, the volume of a corresponding chamber on its one side increases and, on its other side, the volume of the corresponding chamber decreases. During the return movement of the piston element, a corresponding reversal of this process takes place.

In order to particularly effectively dampen the motor noise of the drive means, the latter is arranged outside of the air flow.

Unless it is intended to perform purely an air circulation by the ventilation device, the chamber co-acts with a primary air feed means. During the suction procedure, not only room air will be sucked into the chamber but also primary air will be delivered thereunto, so that both room air and the primary air are blown into the room during the expulsion step.

The invention also relates to the use of an air propulsion installation according to one or more of the claims or according to the above-discussed embodiments of a ventilation device for ventilating a room zone or a room. In addition to the ventilation, an air treatment may also obviously be carried out.

Figure 3:
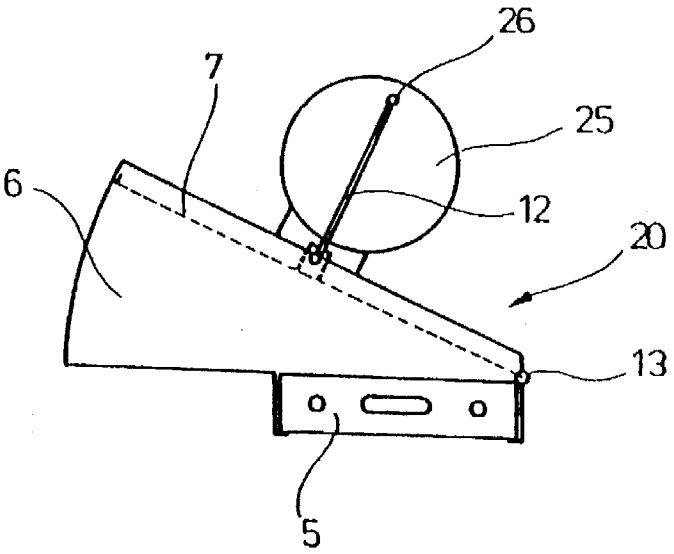
Figure 2:
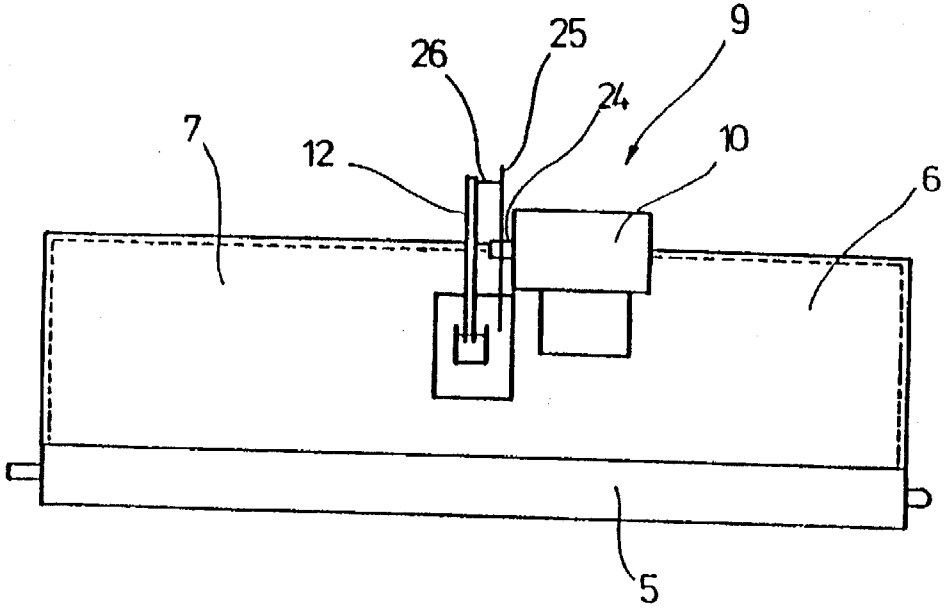
Figure 4:
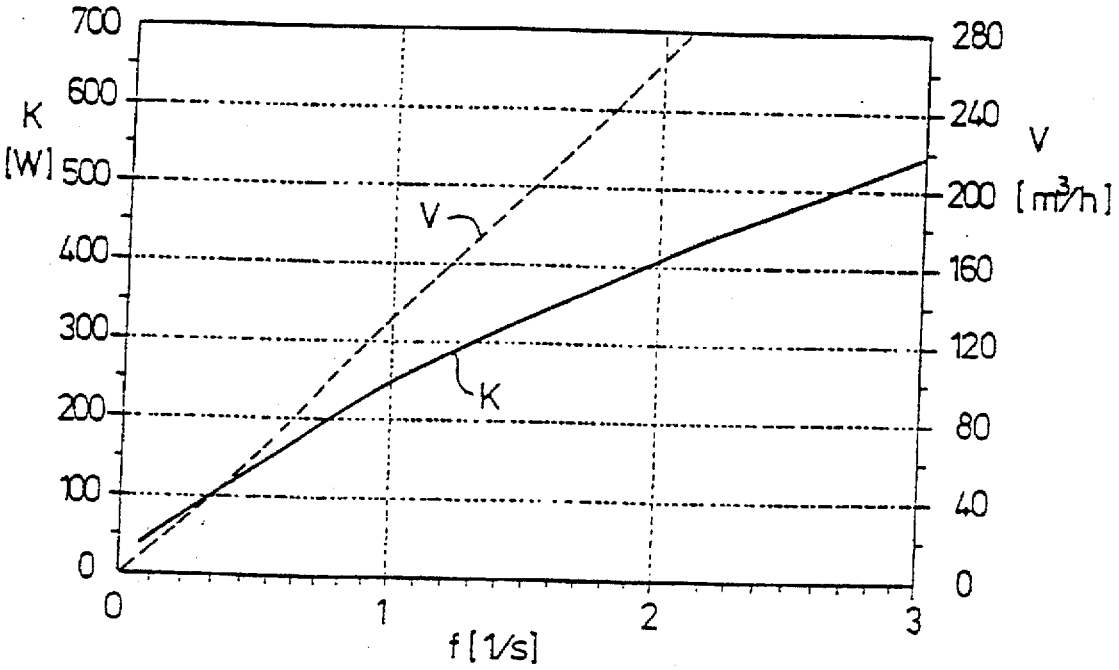
Figure 5:
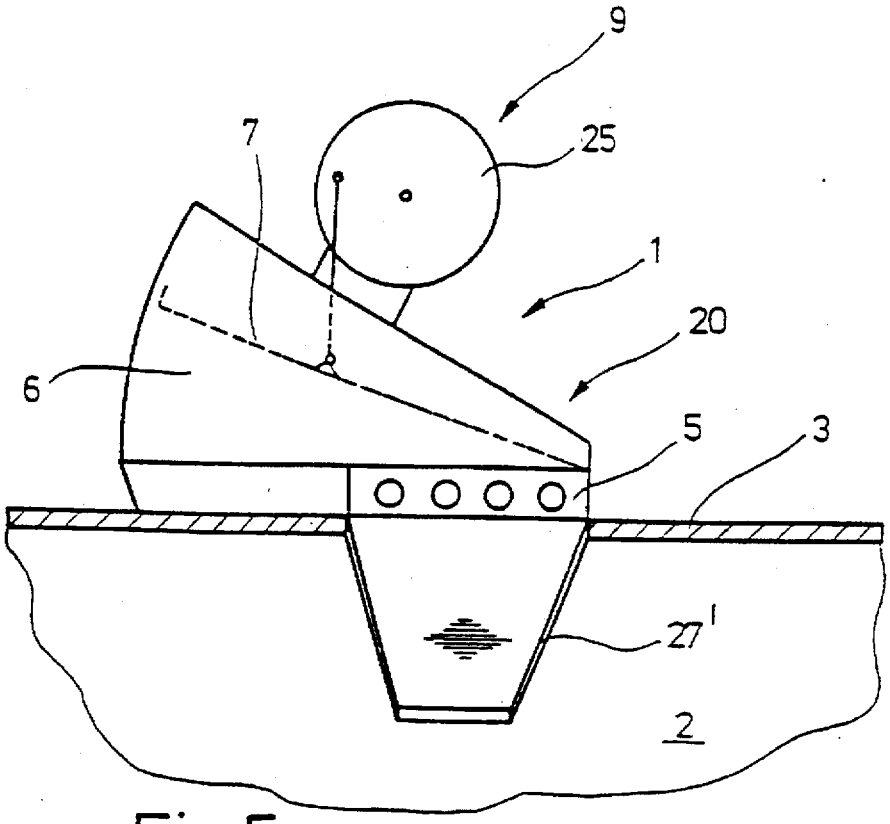
Figure 6:
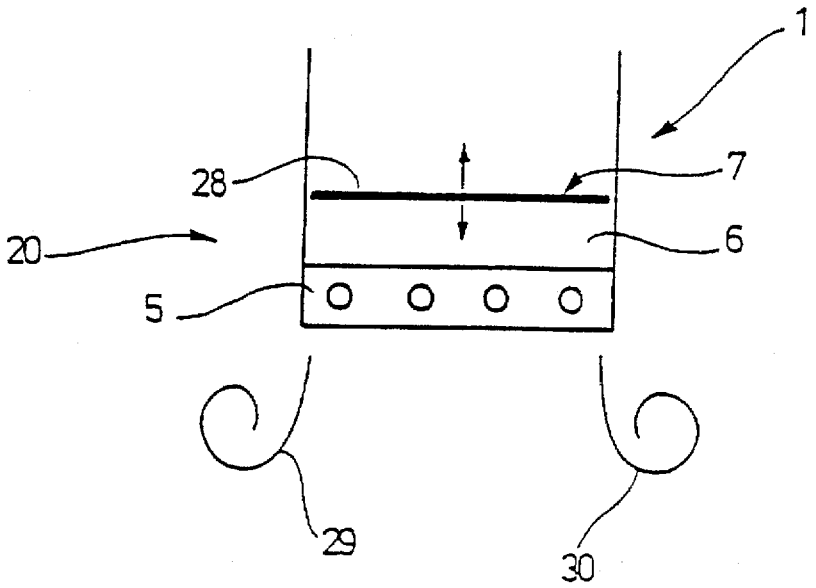
Figure 7:
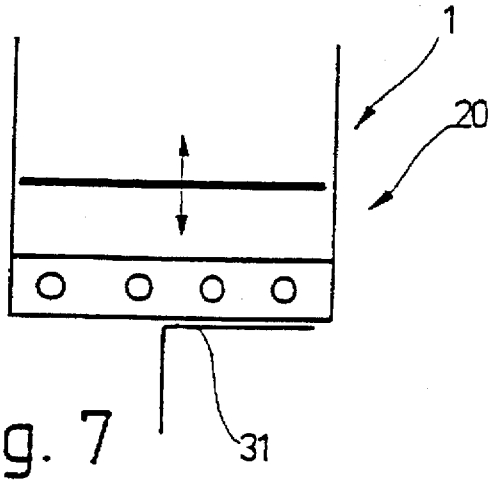
Figure 8:
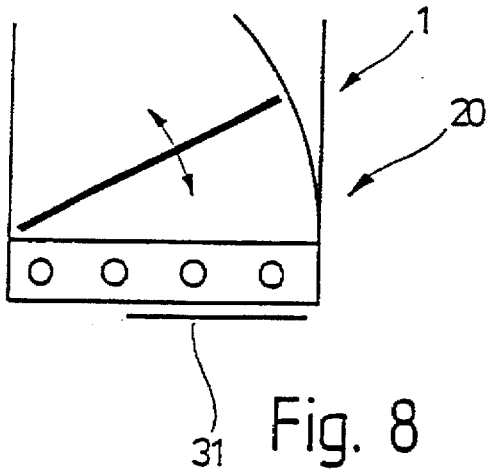
Figure 9:
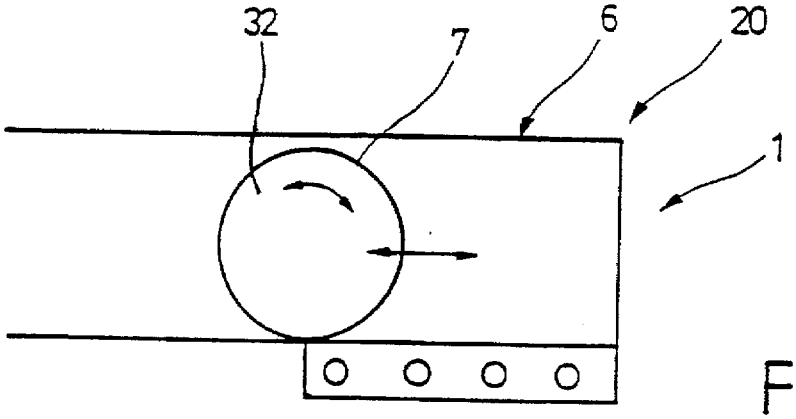
Figure 10:
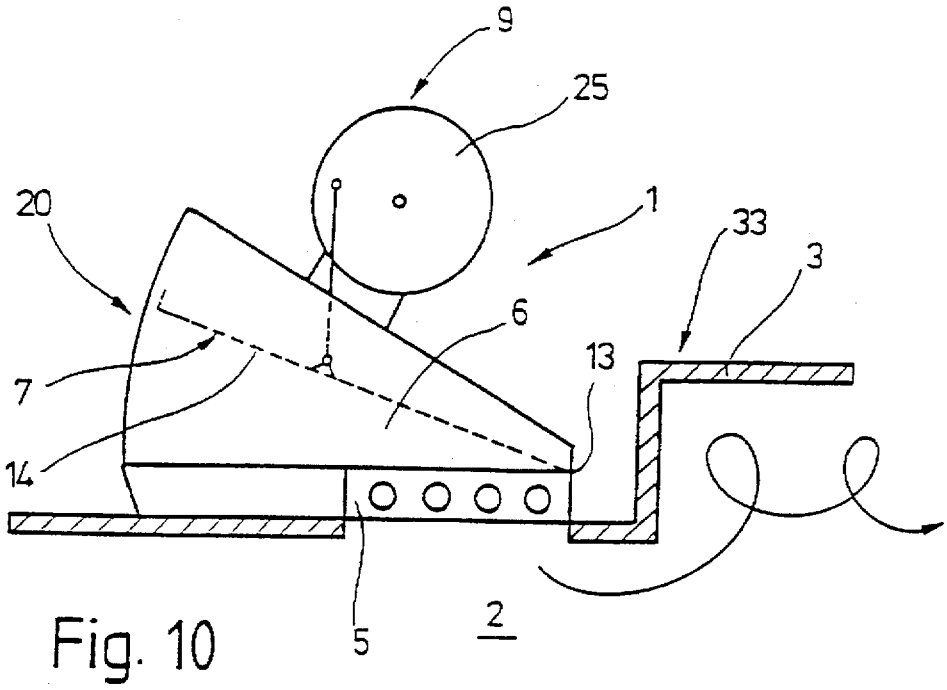
Figure 11:
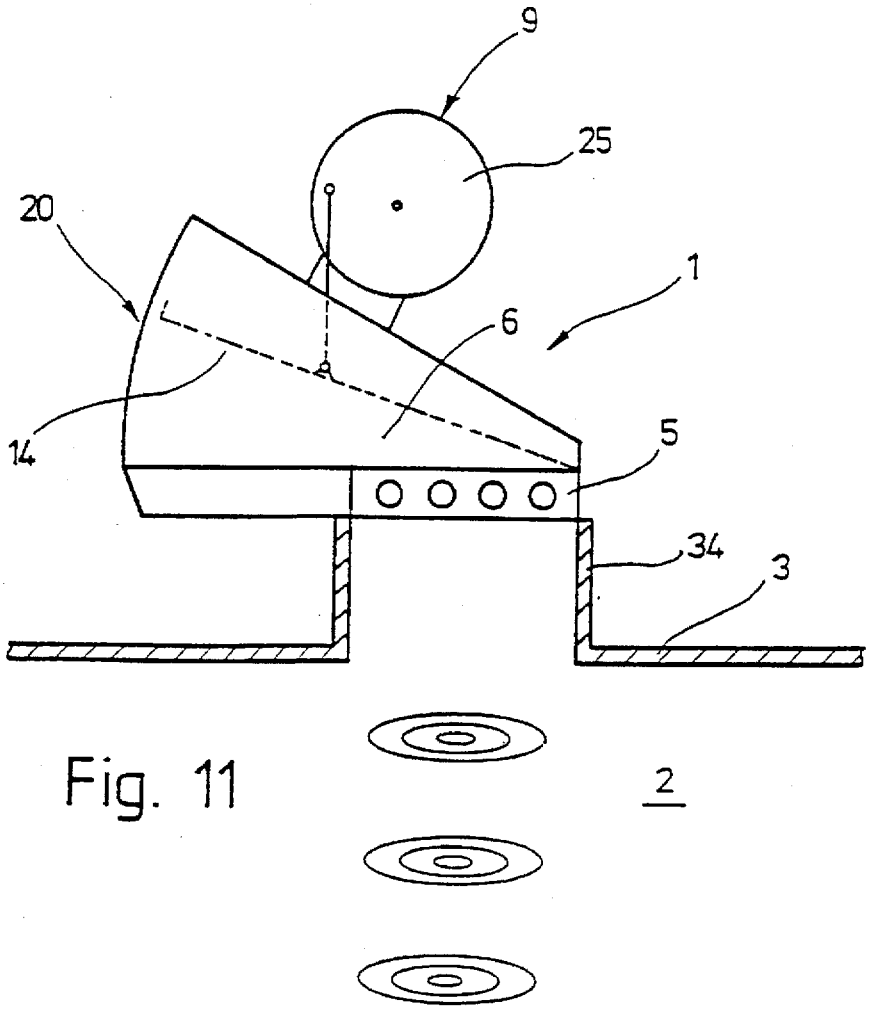
Figure 12:
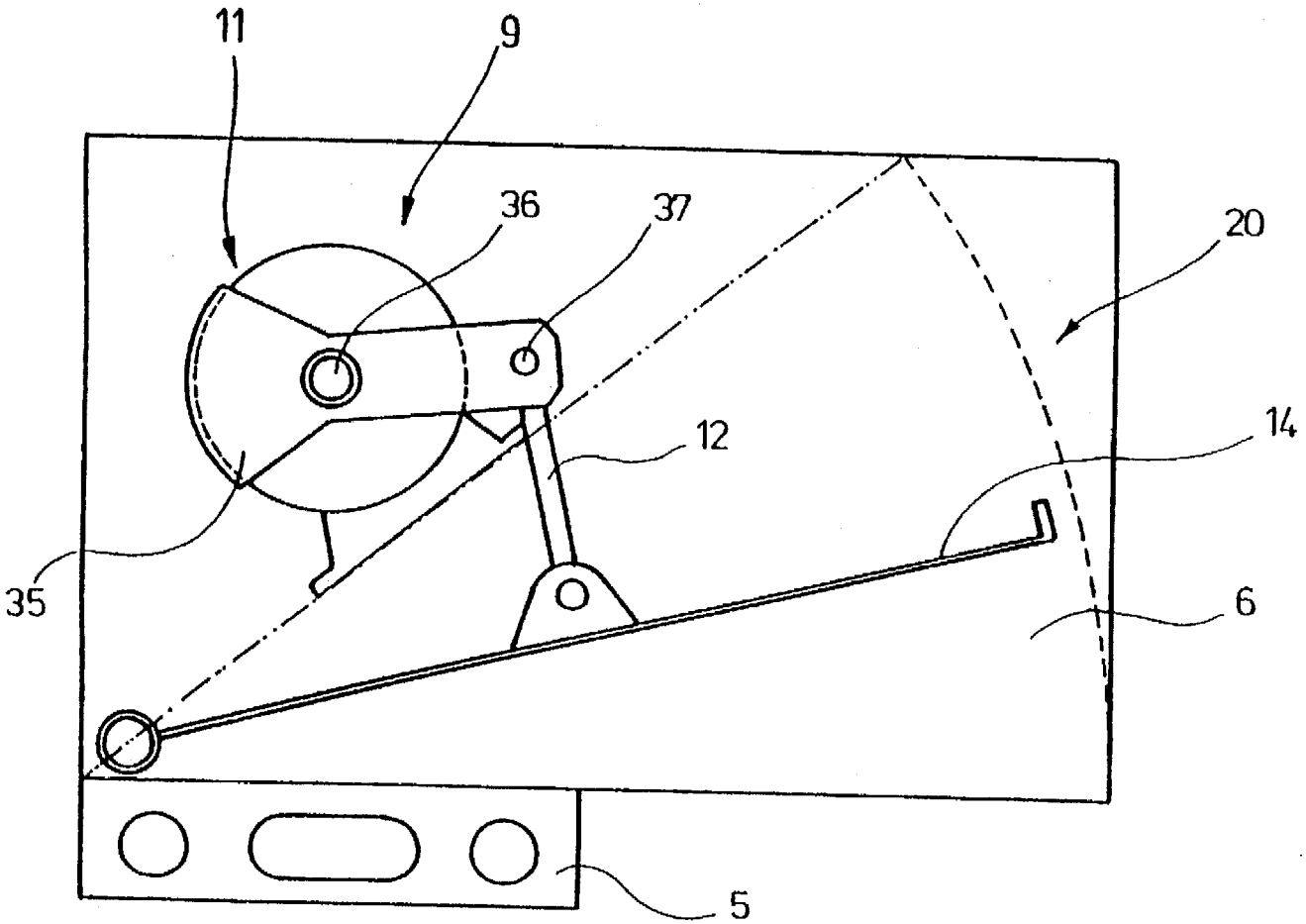
Figure 14:
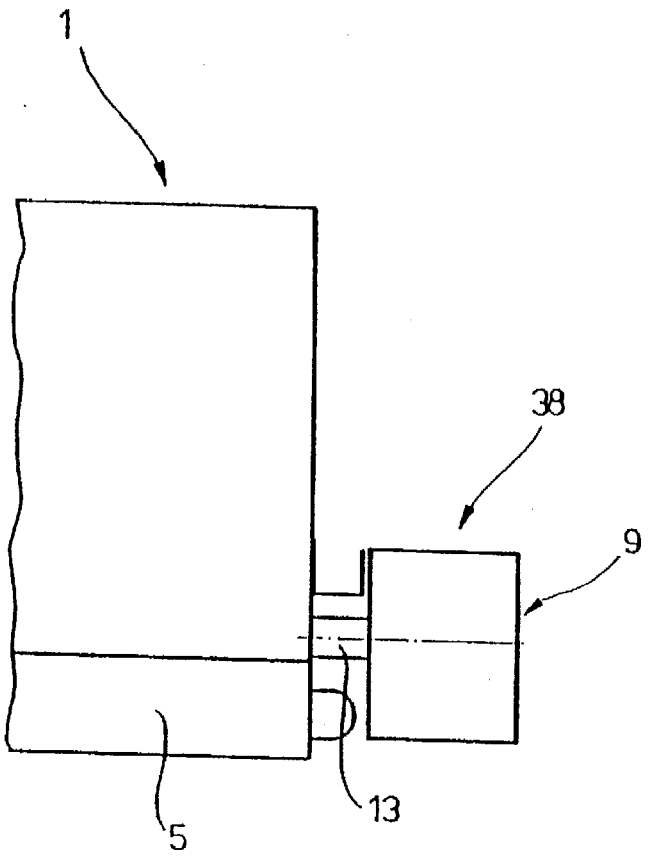
Figure 13:
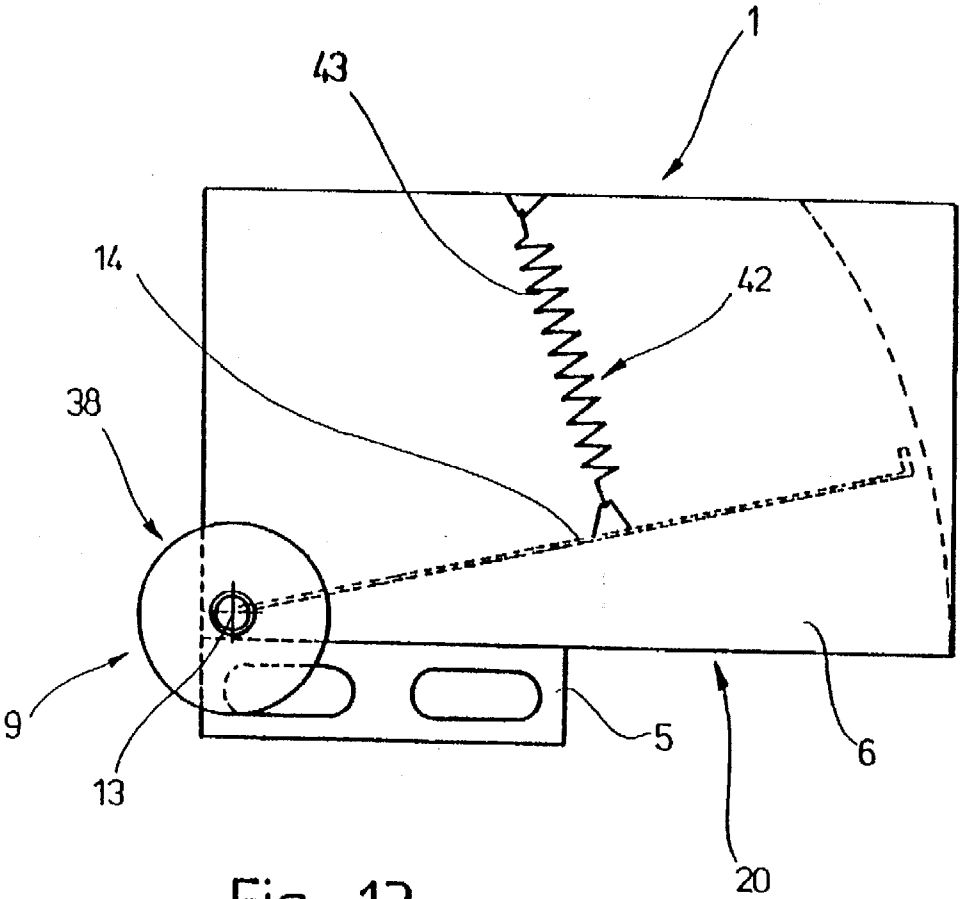
Figure 16:
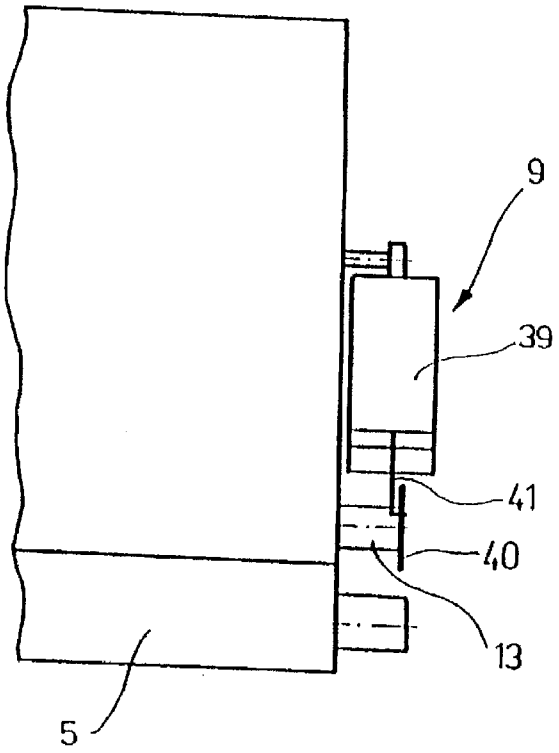
Figure 15:
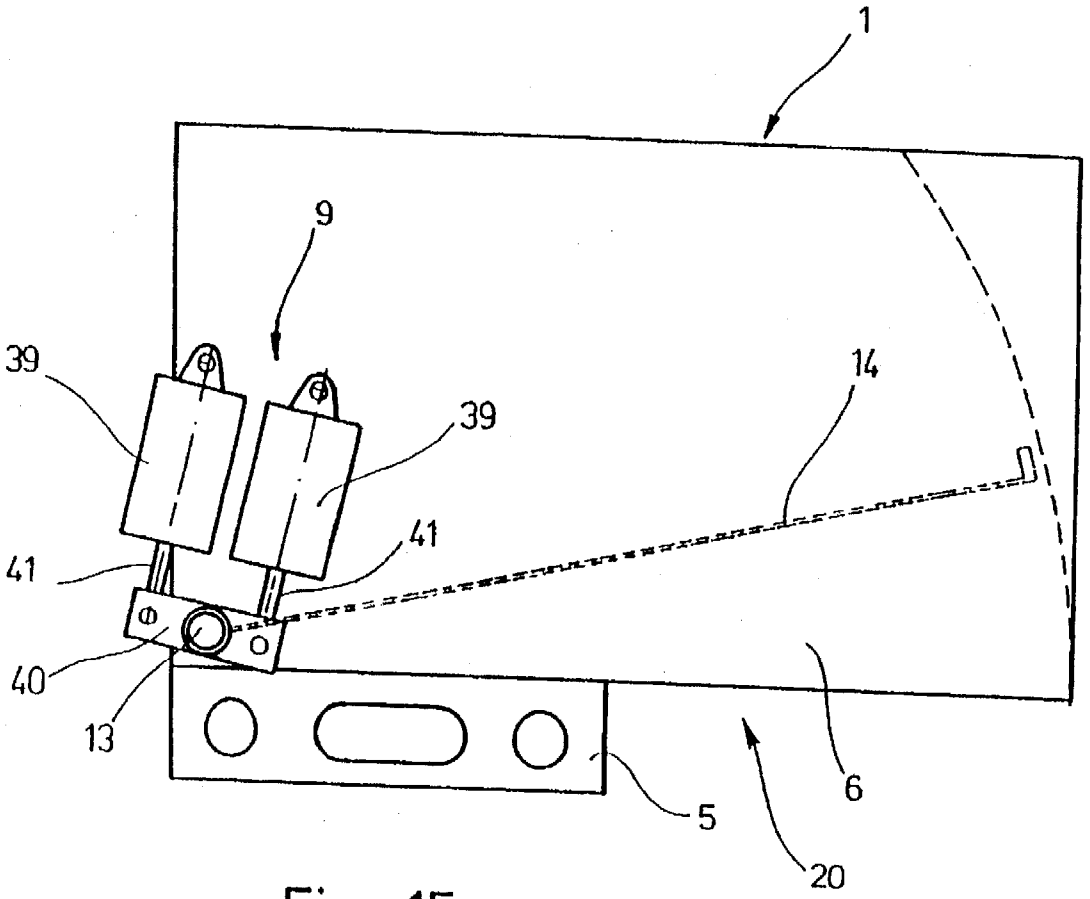
Figure 17:
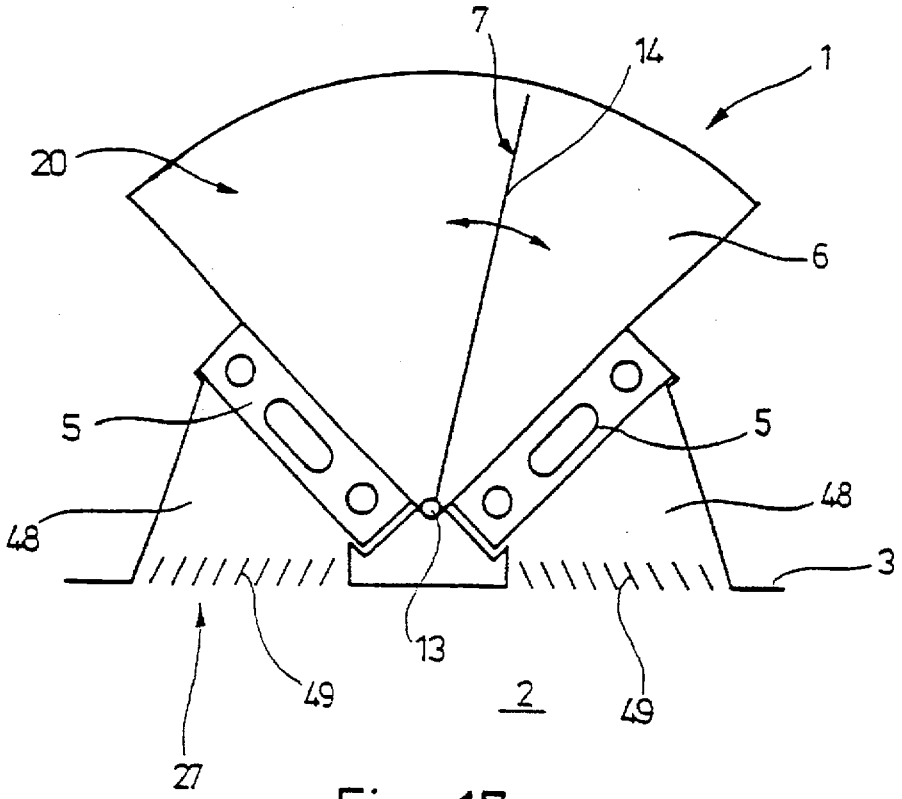
Figure 18:
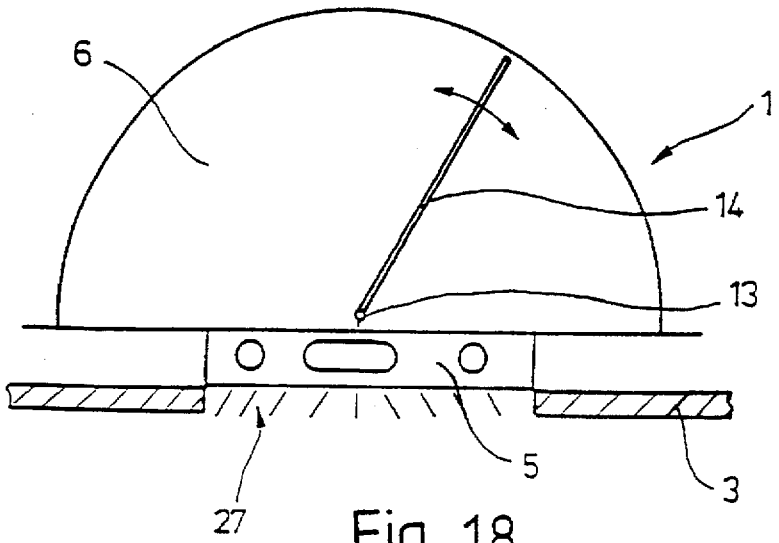
Figure 19:
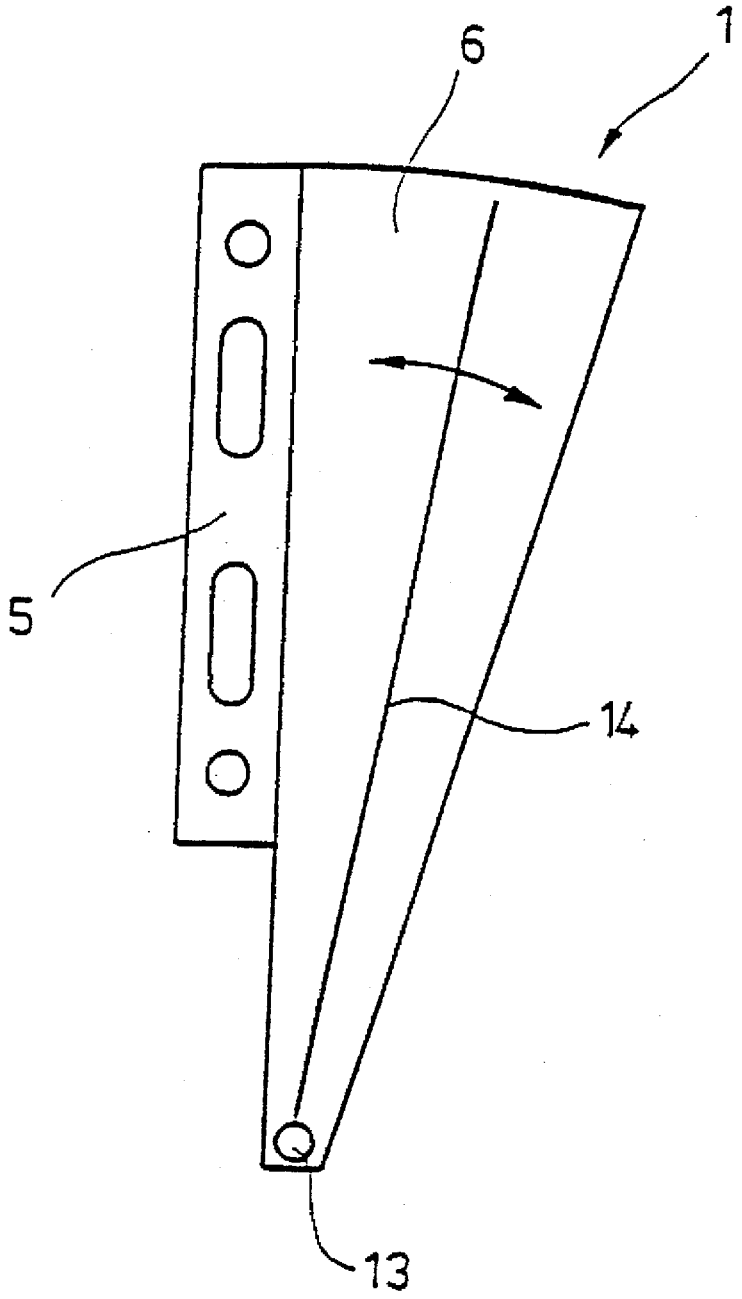
Figure 20:
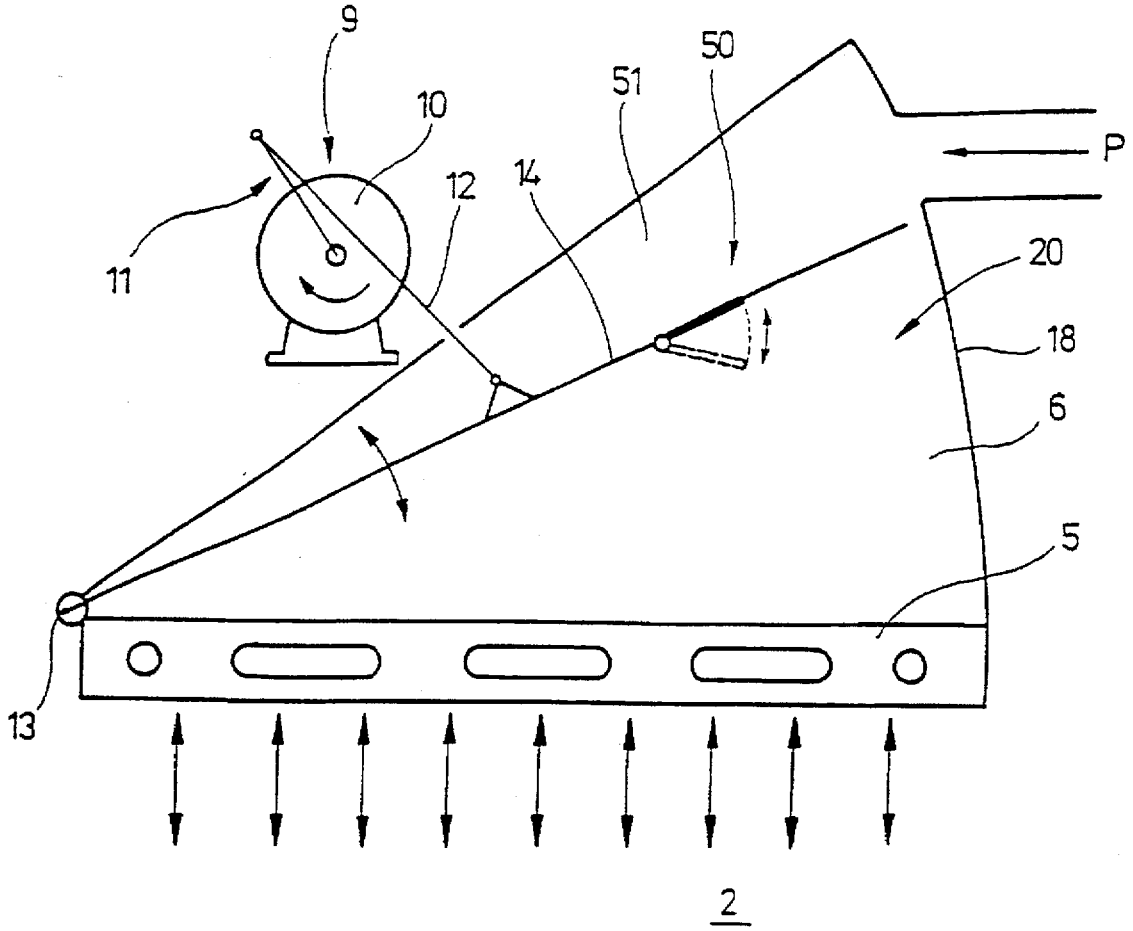
Figure 21:
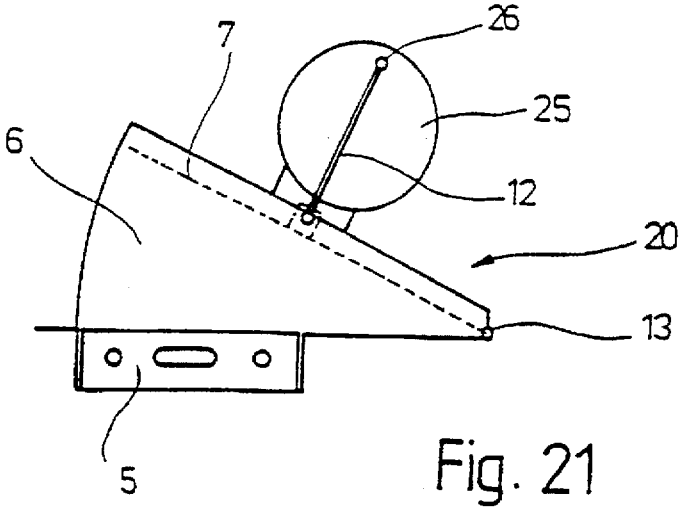
Figure 22:
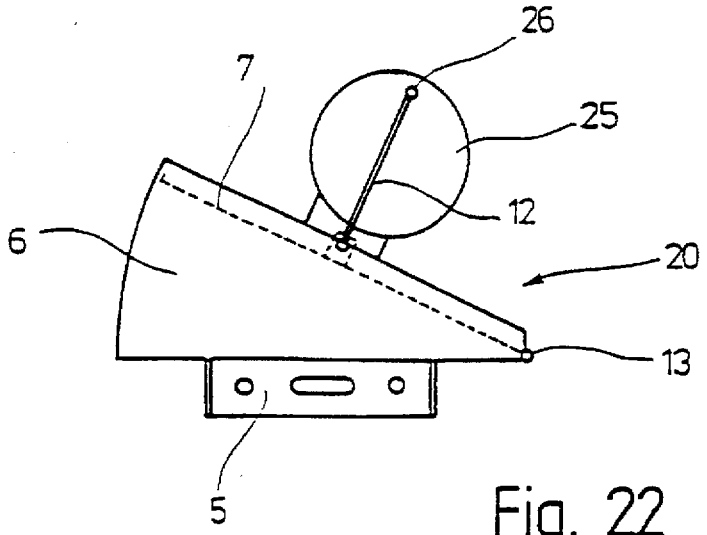
Figure 23:
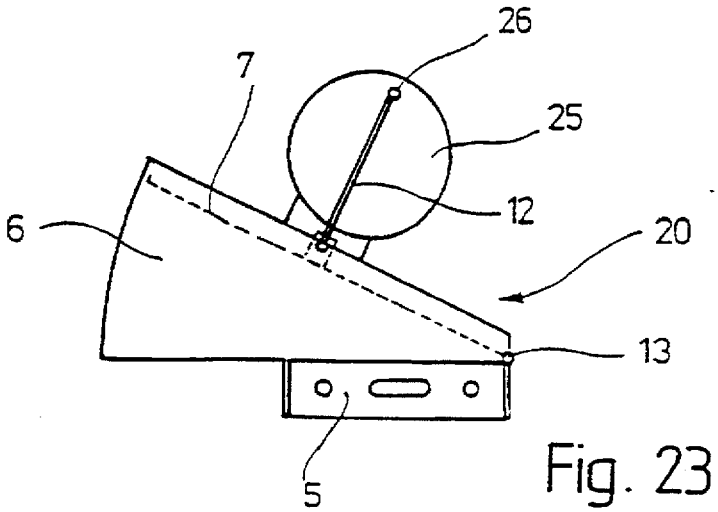
Figure 24:
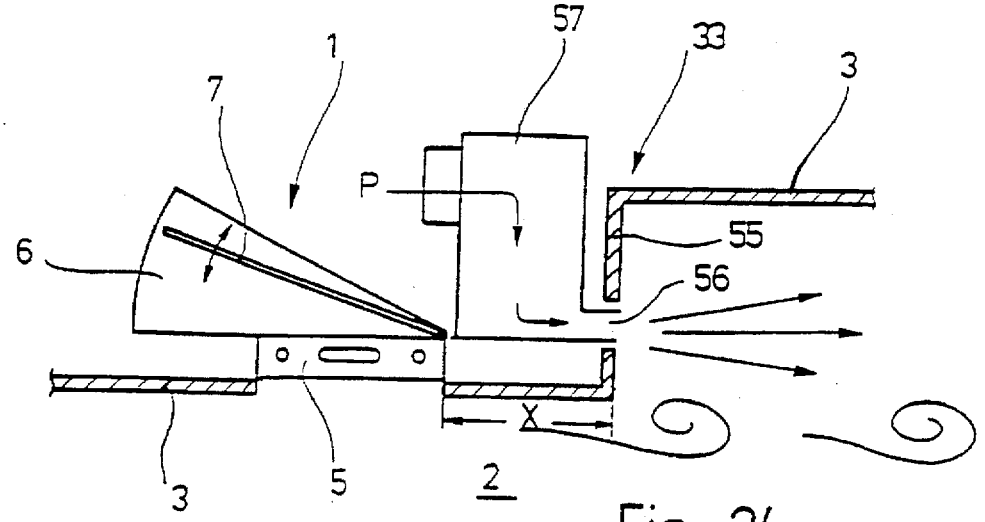
Figure 25:
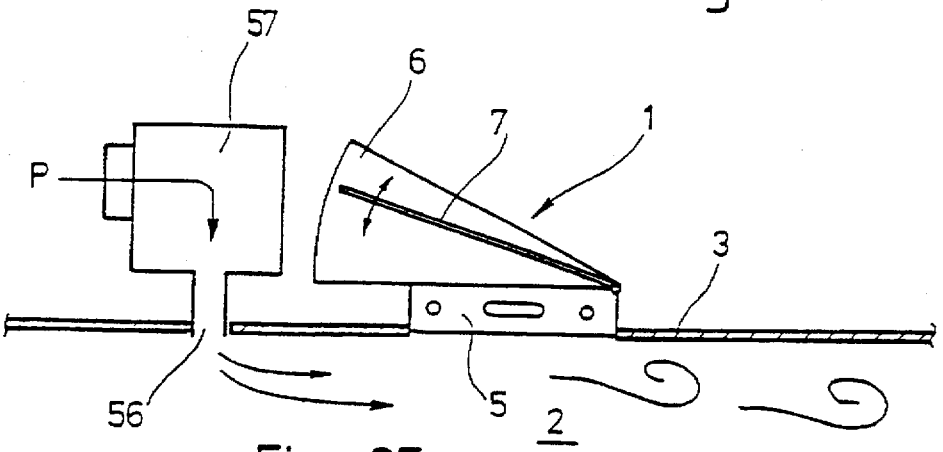
Figure 26:
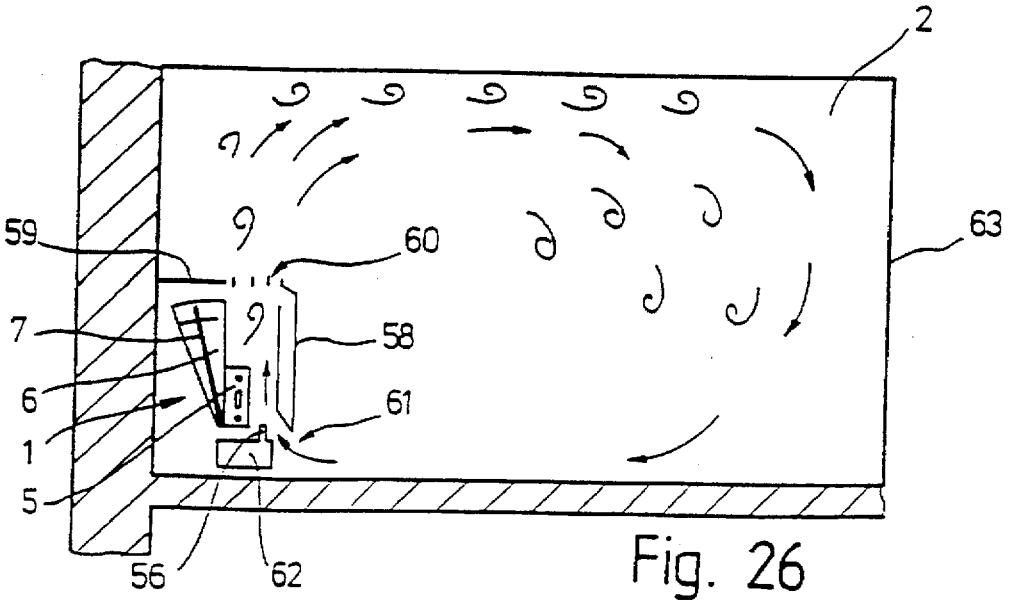
Figure 27:
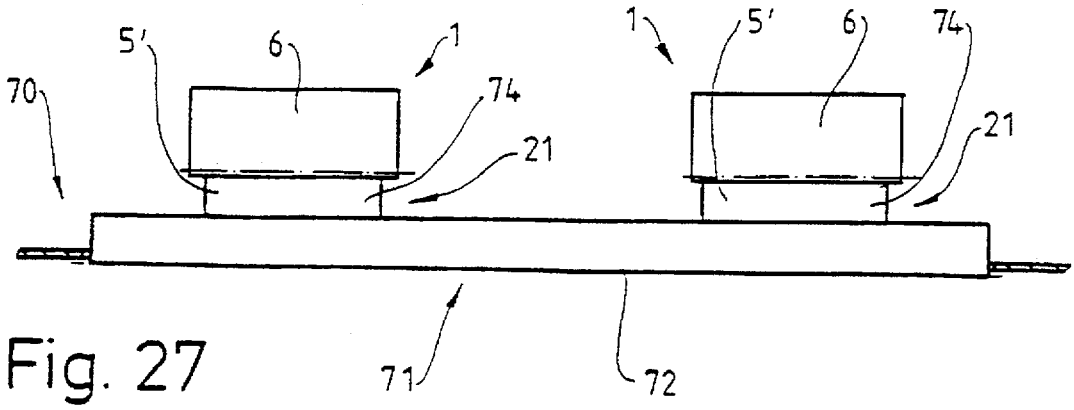
Figure 28:
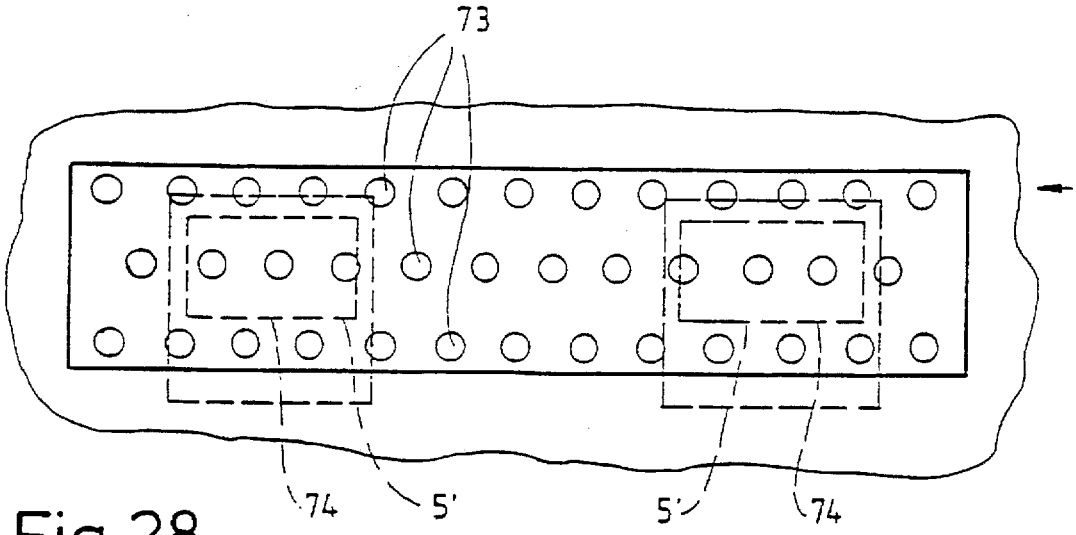
Figure 29:
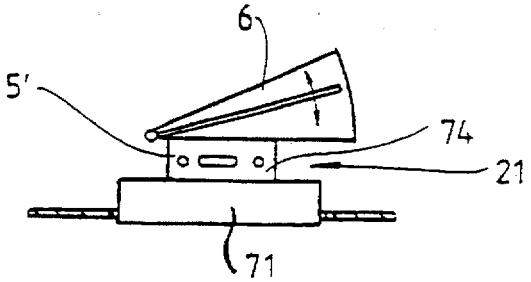
Figure 30:
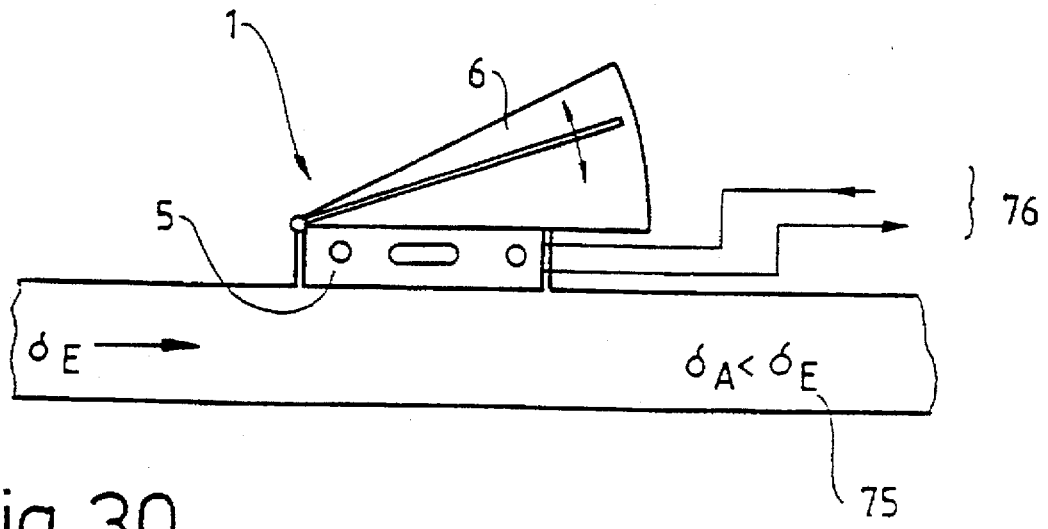
Figure 31:
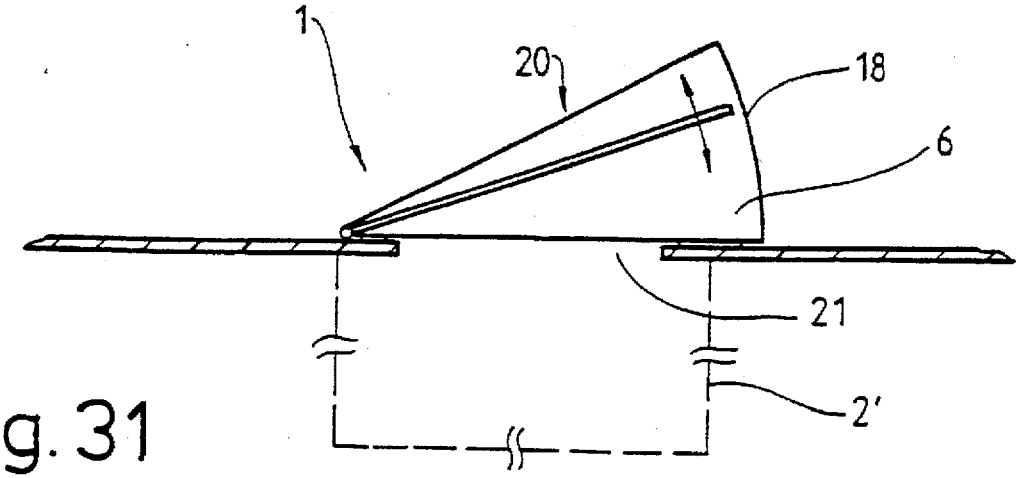
Figure 32:
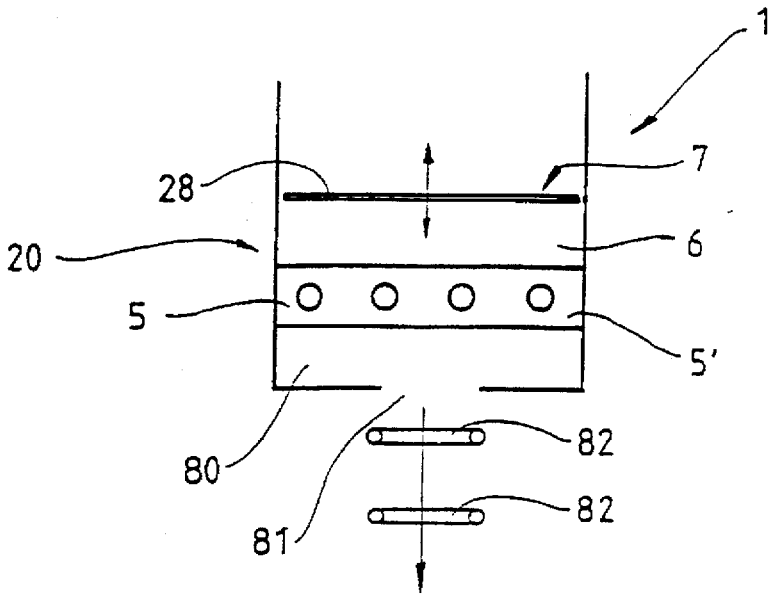
Figure 33:
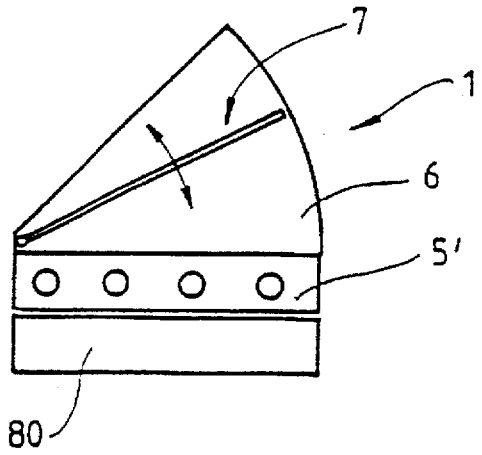
Figure 34:
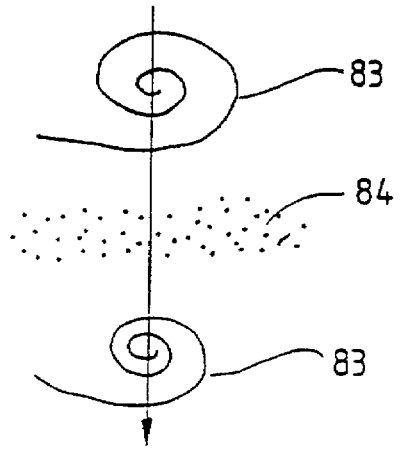
Figure 35:
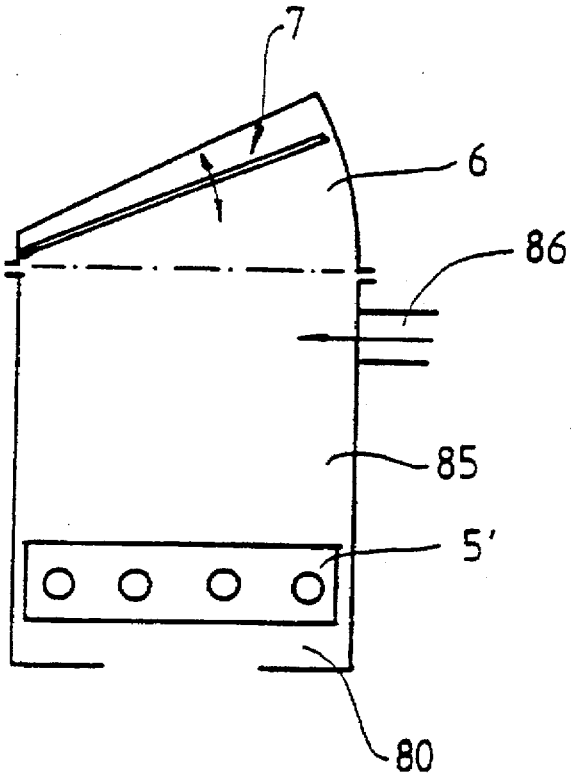
Figure 36:
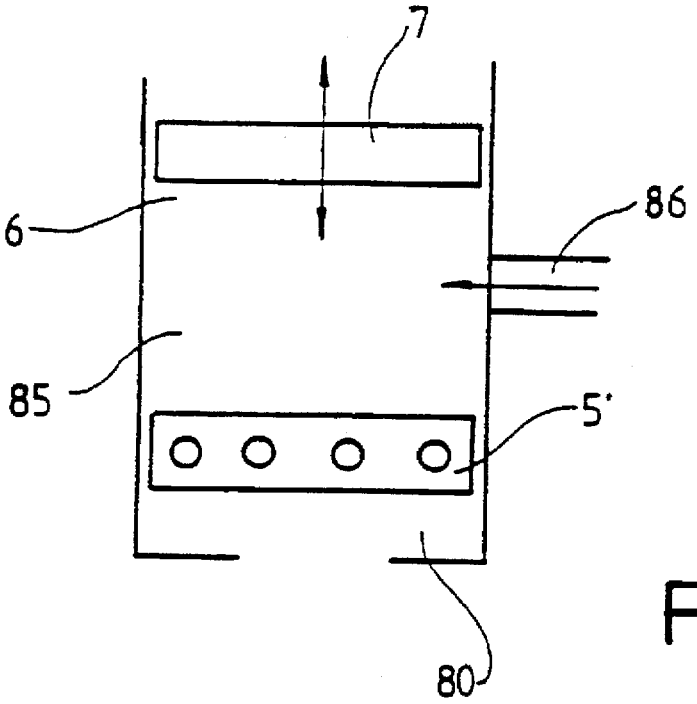

The drawings illustrate the invention with reference to the embodiments of the invention and show:

FIG. 1 a schematic view of a ventilation device for heating or cooling a room, FIG. 2 a rear view of a device provided with an excentric drive means, FIG. 3 a side view of the device according to FIG. 2, FIG. 4 a diagram, FIG. 5 a perspective view of a ventilation device installed in a ceiling of a room, FIG. 6 a schematic illustration of a ventilation device having a symmetrical air outlet, FIG. 7 a ventilation device with air guide means, FIG. 8 a further embodiment of a device according to FIG. 7, FIG. 9 a schematic view of a piston element modification of a device, FIG. 10 a device installed in a ceiling step, FIG. 11 a device installed in an air duct, FIG. 12 a ventilation device with an excentric drive means, FIG. 13 a ventilation device with a rotary magnetic drive means, FIG. 14 a side elevational view of the device according to FIG. 13, FIG. 15 a device with a linear stroke magnetic drive means, FIG. 16 a side view of the device according to FIG. 15, FIG. 17 a double acting ventilation device, FIG. 18 a double acting ventilation device according to a different embodiment, FIG. 19 a ventilation device in a vertical installation position, FIG. 20 a ventilation device with an additional primary air feed, FIG. 21 a ventilation device with a heat exchanger remote from the pivoting axis, FIG. 22 a ventilation device with a centrally arranged heat exchanger, FIG. 23 a ventilation device with a heat exchanger associated with the pivoting axis, FIG. 24 a ventilation device with an associated primary air feed means, FIG. 25 a device according to FIG. 24, however, in accordance with a different embodiment, FIG. 26 a room equipped with a ventilation device and additional primary air feed means, FIG. 27 a side elevational view of a ventilation device forming part of a gate air curtain installation, FIG. 28 a bottom view of the device according to FIG. 27, FIG. 29 an end view of the device in the direction of the arrow in FIG. 28, FIG. 30 a ventilation device for use in waste heat utilization, FIG. 31 a ventilation device serving only for the propulsion of conveyed air and comprising no air treatment means, FIG. 32 a ventilation device with air guiding means, FIG. 33 a different embodiment of a ventilation device with air guide means, FIG. 34 a diagrammatic illustration which demonstrates how the air flow into a room can be influenced, FIG. 35 a ventilation device which is fed with primary air, FIG. 36 a further embodiment corresponding to FIG. 35.

FIG. 1 shows a working example of a ventilation device 1 for heating or cooling a room 2. The room 2 is merely indicated in FIG. 1 by an arrow. It is to be assumed that the ventilation device 1 is accommodated in a suspended ceiling of the room 2. The visible ceiling 3 of the room 2 is in approximate alignment with the underside 4 of a heat exchanger 5 of the ventilation device 1. The heat exchanger 5 is connected to a cold water source (cooling) or hot water source (heating).

The heat exchanger 5 is adjoined by a variable volume chamber 6. The volume change is effected with a piston element 7 which can be moved in the directions of the double arrow 8. The movement is effected by a drive means 9 which includes an electric motor 10 which drives an excentric device 11. The excentric device 11 is connected by a rod 12 to the piston element 7.

According to the embodiment of FIG. 1, the piston element 7 is designed as a displacement element 14 which is pivotable about an axis 13 as a flap. The axis 13 is provided in the immediate vicinity of the upper edge 15 of the heat exchanger 5. The free end 16 of the displacement element 14 is spaced from a wall 18 of the chamber 6 by a gap 17, the wall 18 being shaped so as to correspond to the movement trajectory of the displacement element 14. Parallel to the plane of the drawing of FIG. 1, on both sides of the displacement element 14, further walls, not illustrated in the drawing, are provided, likewise allowing for a gap in relation to the displacement element 14.

In operation (for example for cooling), the displacement element 14, which preferably is designed as a panel is swung from the illustrated angular position of about 25° to an end position, in which it is located parallel to and at a small distance from the upper side 19 of the heat exchanger 5. Here a reversal of the movement and a swinging back into the uppermost end position takes place, and so forth. Air inside the room 2 will be sucked, by virtue of the thus formed air propulsion plant 20 through an air passage 21 essentially formed by the heat exchanger 5, into the chamber 6 during the volume increase thereof, and is thereby, in the assumed cooling situation, cooled in a first step. When thereafter the excentric device 1 passes its upper dead point, the chamber volume is decreased, and the cooled air is expelled along the same route, that is once again by passing through the air passage 21 (this time, however in the opposite direction) into the room 2. When passing the heat exchanger 5, a second cooling step takes place, the two cooling steps resulting in the expelled air having the desired temperature. It was surprisingly found that between the sucked in and the expelled air no short-circuit takes place, that is the identical or almost identical air volume is not continuously drawn in and expelled again. Rather, the expelled air is separated as a vortex or a plurality of vortices and penetrates into the room interior. The air subsequently drawn in by the ventilation device 1 is therefore not identical to the expelled air so that a circulatory operation takes place. Because of the flap principle in the embodiment of FIG. 1, the expulsion process on the right-hand side remote from the pivoting axis 13, results in an increased velocity of the expelled air, which causes the preferential formation of a vortex displaced towards the right, i.e., away from the axis 13, as indicated by the reference number 22. Because of this asymmetry, a particularly effective vortex separation takes place and, moreover, a short-circuit effect is entirely avoided. The asymmetrical configuration, however, is not a prerequisite for the success of the invention, because, as will be shown further below, no appreciable short-circuit effects arise even in the event of the vortex being expelled symmetrically.

In order for the invention to succeed, it is furthermore not necessary for the movement of the piston element to proceed periodically. A periodic movements are also feasible. These may follow a sinusoidal pattern, but preferably have a brief pause period at the end of the expulsion phase or an abrupt reduction in velocity which results in a very effective vortex separation. The faster is the movement of the piston element 7 during the expulsion process, the stronger will be the pulse and the further will the vortex penetrate into the room. The opening movement of the flap (sucking in step) may, on the other hand, proceed relatively slowly. The sucking in and the expulsion process of the air is indicated in FIG. 1 by double arrows 23.

Since the piston element 7 is moved with a relatively low frequency (0, 1 to a maximum of 30 cycles per sec.), and, accordingly an extremely low frequency device is provided, the obtained results are acoustically extremely good. The electric motor 10 moreover is not in the air flow, so that motor noise is substantially damped. A control or regulation of the air circulation and thereby of the heating or cooling output can be effected by a variation of the speed of the piston element. In this context, the stroke length also plays a decisive role. Then the dead volume. The dead volume designates the space which does not participate in the enlargement or reduction of the chamber 6. In the embodiment according to FIG. 1, this is represented essentially by the interior of the heat exchanger 5 which forms the air passage 21. This dead volume should be kept as small as possible and in any event, very much smaller than the maximum volume of the chamber 6. For that reason, it is less advisable to achieve a particular air throughput to be attained with a small stroke and a high frequency, but rather the opposition situation should be striven for i.e., a large stroke and a low frequency. The latter is limited by the resultant increasing structural size.

In the chamber 6 mixing of the air hardly takes place because the heat exchanger lamellae of the heat exchanger 5 act as parallel guides.

In FIGS. 2 and 3 the embodiment according to FIG. 1 is once again shown in a modified form. A circular disc 25 from which an excentric bolt 26 engaging the rod 12 projects, is mounted on the shaft stub 24 of the electric motor 10. The rod 12 is pivotally attached the displacement element 14.

FIG. 2 shows that the chamber 6 extends actually over the entire depth of the heat exchanger 5, but not—as shown in FIG. 3—only with regard to the length of the heat exchanger 5 but also beyond it. Accordingly, the base area 6 of the chamber 6 adjoining the heat exchanger 5 is greater than the base area of the heat exchanger 5. The arrangement has been so selected that the base area of the heat exchanger 5 is offset relative to the base area of the chamber 6 in the direction of the axis 13. This results in a powerful vortex formation with vortices which separate in an optimal manner.

FIG. 4 shows a diagram illustrating the cooling output K and the volume flow V as a function of the stroke frequency f of the ventilation device 1. It will be seen that within the frequency range shown in FIG. 1, the volume flow V increases linearly. The increase of the cooling efficiency K as a function of the stroke frequency f proceeds in a non-linear manner.

FIG. 5 shows a perspective view of the ventilation device 1 installed in the sectionalised ceiling 3 of the room 2. An aperture 27' in the ceiling 3 is clearly visible which is adjoined by the heat exchanger 5. The expelled vortices can be guided into a desired direction by suitable air guidance elements which have not been illustrated. Such air guidance elements or discharge grids, although causing some additional pressure loss, nevertheless reduce the risk of a short-circuit.

FIG. 6 shows a schematic view of a further embodiment of a ventilation device 1 which, as a piston element 7 comprises a panel 28 subjected to translational movement. Drive means which effect such movement are known to the person skilled in the art, e.g., lifting magnets. In view of the symmetrical design, symmetrical vortices 29, 30 will be formed when expelling the air. Likewise, these vortices 29, 30 are separated and penetrate into the room so that the air subsequently sucked into the chamber 6 is not identical to the expelled air. Short-circuits will, therefore take place only to a minimal extent. The vortex formation is assisted if blinds are provided in the region of the inlet or outlet aperture that is in front of the heat exchanger 5 or at the edge of the heat exchanger 5. Such blinds 31 are indicated in the embodiments of FIGS. 7 and 8. Such blinds 31 cause the formation of so-called stop vortices which are separated very effectively.

In FIG. 9 a further embodiment of a ventilation device 1 is shown, in which the piston element 7 is formed by a roll 32 which is rolled back and forth in the chamber 6 by its own suitable drive means, whereby the chamber volume is expanded or reduced.

The drive means may, according to embodiments which have not been illustrated, correspond to what is, e.g., known in the case of tool carriages of horizontal slotting machines (e.g., planning machines). This results in a very rapid expulsion movement for the air and a relatively slower sucking in movement.

FIG. 10 shows an embodiment of the invention which corresponds to the embodiment of FIGS. 2 and 3. Only differences will be discussed below. These differences reside in the configuration of the ceiling 3 of the room 2. In that region which is associated with the axis 13 of the pivotable displacement element 14, a step 33 is formed in the ceiling 3, that is the height of the ceiling of the room 2 in the region of the heat exchanger 5 is less than that following the step 33. The step 33 has an aerodynamic effect in that it "attracts" expelled vortices, causing their deflection. This is advantageous for avoiding short-circuit effects. So-called bar vortices are formed which run along the ceiling and further promote penetration of the cooled air into the room 2.

In the embodiment according to FIG. 11, the ceiling 3 of the room 2 is provided in the region of the heat exchanger 5 with a neck 34 which guides the expelled vortices in an appropriate direction. The expelled vortices accordingly penetrate into the room 2 in a downwardly guided manner. This is particularly important when introducing warm air.

The embodiment according to FIG. 12 once again shows a construction with a "pivoting piston." It is there made clear that the excentric device 11 may be provided with a counterweight 35 which, with regard to the axis of rotation of the drive means, is arranged diametrically opposite to the linkage point 37 of the rod 12. This permits to substantially avoid vibrations which may be triggered by uneven running.

FIGS. 13 and 14 show a ventilation device 1 which, in comparison with the previous embodiments, are provided not with an excentric drive but with a rotary magnetic drive 38. The rotary magnet drive 38 is mounted directly on the axis 13 of the pivotable displacement element 14. A pivoting angle of, for example, 45° may be realized. The direct flange mounting of the rotary magnet drive 38 on the axis 13 permits to avoid the application of traverse forces to the flap bearing. The rotary magnet drive 38 is controlled by an appropriate electrical control unit to provide for the desired movement (acceleration, velocity, pivoting range, etc.)

The embodiment according to FIG. 13 shows a return device 42. This return device 42 is formed by a return spring formed as a tension spring fitted at one end thereof to the displacement element 14, with its opposite end being fixed. It is designed to return the pivotable displacement element 14 in the direction towards the upper dead point position. Instead of the embodiment illustrated in FIG. 13, it is also feasible to provide return means which additionally or exclusively operate according to the gravity principle, that is the piston element 7 is moved back to its initial position under its own weight.

The flap-shaped displacement element 14 may oscillate at the resonance frequency of the system composed of the return spring 43 and the mass of the "flap". The excitation of the oscillations is effected by an appropriate magnetic excitation of the rotary magnet 38. The magnitude of the current through the coil of the rotary magnet 38 determines the degree of excitation. It is necessary to time the excitation in accordance with the position of the flap. The system is damped by air resistance.

Alternatively, the embodiment of FIG. 13 is also feasible without the return device 42.

FIGS. 15 and 16 show a further modification of an electro-magnetic drive in which linear displacement magnets 39 are employed. As in the case of the rotary magnet drive 38 of FIGS. 13 and 14, the linear displacement magnets 39 in the embodiment of FIGS. 15 and 16 are magnetized by an electrical current which flow through appropriate coils. The axle 13 of the displacement element 14 is fixedly connected to a double lever 40, each end of which is attached to one of the two linear displacement magnets 39 by operating rods 41. By appropriate control of the linear displacement magnets 39, with one linear displacement magnet 39 pushing and the other one pulling, a pivotal movement of the displacement element 14 is generated by application to the axis 13 of a torque without application shearing forces to the axis 13.

It is particularly advantageous if the piston element 7 is of very light construction, for example, is made as a sandwich structure of a panel and a honeycomb structure. It is also possible to employ plastics-coated rigid foam panels or thin-walled hollow structures.

With the above-discussed electro-magnetic drive, a provision can always be made to avoid impact either of the anchor or the displacement element against other components. This possible by a suitable control or regulation of the excitation current.

FIG. 17 shows a double acting ventilation device 1. The latter comprises two heat exchangers 5, set up at an obtuse angle to one another, jointly associated with a double chamber or each with a chamber 6. The piston element 7 takes the form of a pivotable displacement element 14, the axis 13 of which is located in the lower region between the two heat exchangers 5. The heat exchangers 5 are in communication with the room 2 by appropriate air passages 48 in which air guide elements 49 may be provided. A pivotable movement of the displacement element 14 causes volume increase on its one side and volume decrease on its opposite side. This means that air is sucked in from the room 2 through the one heat exchanger 5 and, on the other side of the displacement element 14, air is expelled into the space 2 from the corresponding chamber, due to the volume decrease, through the other heat exchanger 5.

FIG. 18 shows a further embodiment of a double acting ventilation device 1. This, in contrast to the embodiment on FIG. 14, has only one heat exchanger 5, which, however, is associated with a double chamber. In this context, the axis 13 of the displacement 14 is fitted approximately centrally in relation to the heat exchanger 5 so that in each case approximately half of the heat exchanger 5 is used for the respective sucking in and the simultaneous expulsion step of each chamber 6.

FIG. 19 merely shows a further installation position of the ventilation device 1, which differs from the aforesaid embodiments. In this case, the ventilation device 1 is vertically installed, i.e., it may, for example, be installed in a wall of the room 2. Preferably, the pivoting axis 13 of the flap-shaped pivotal displacement element 14 is provided on the downward side, that is the flap is not suspended but mounted in a standing position.

The embodiment according to FIG. 20 differs from that according to FIG. 1 in that the flap-shaped displacement element 14 comprises a check valve 50, for example, likewise in the form of a flap. Above the displacement element 14, a further chamber 51 is formed which communicates with primary air P. This primary air P may be pressureless or pressurized. If, in accordance with FIG. 20, the displacement element 14 is swung upwardly, the check valve 50 opens so that primary air can flow into the chamber 6. This takes place in addition to the air sucked in from the room 2. During the downward movement of the displacement element 14, the check valve 50 closes so that both, the air sucked in from the room 2 as well as the primary air prevailing in the chamber 6, are expelled into the room 2. Accordingly, in the embodiment of FIG. 20, the operation is not purely one of air circulation but one of air circulation combined with the use of primary air.

FIGS. 21 to 23 show embodiments of the invention in which the heat exchanger 5 in each case occupies a different position. The apparatus configuration of FIGS. 21 to 23 corresponds to that of FIG. 3 so that reference may be made thereto. In the embodiment of FIG. 21, the heat exchanger 5 is arranged remotely from the axis 3. Its end, which is opposite to the axle 13, borders on the corresponding wall of the chamber 6. In the embodiment of FIG. 22, the heat exchanger is fitted approximately centrally to the base area of the chamber 6, i.e., it is still spaced from the axis 13, however, by a distance which is smaller than in the embodiment according to FIG. 21. In the embodiment of FIG. 23, the heat exchanger 5 borders directly on the axis 13; it is spaced from the wall of the chamber 6 which is remote from the axis 13.

FIG. 24 shows a ventilation device 1 arranged as in FIG. 10, that is there is a step 33 in the ceiling 3 of the room 2. The step 33 includes a vertical wall 55. The heat exchanger 5 is at a distance x from the lower edge of the wall 55. A primary air outlet 56 opens into the wall 55 and leads to a primary air chamber 57, which is supplied with primary air P. The vortices formed by the ventilation device 1 pass the step 22 and hence meet with the primary air P. The latter may be under a slight excess pressure causing it to penetrate into the room 2. However, in the alternative or in addition, it is also possible for the vortices to induce the conveyance of the primary air P.

FIG. 25 shows a further embodiment of a ventilation device 1 in which likewise a primary air installation is used. The latter comprises a primary air outlet 56, which opens into the ceiling 3 of the room 2. The primary air outlet 56 leads to a primary air chamber 57 which is supplied with primary air P. The arrangement is such that the primary air outlet 56 is on that side of the heat exchanger 5 of the ventilation device 1 which is opposite to the direction of flow of the expelled vortices of the ventilation device 1.

FIG. 26 shows a room 2 of a building or the like equipped with a ventilation device 1. The latter is installed underneath a covering 58 in a corner region formed by a wall and the floor of the room 2. The covering 58 comprises in its horizontal region 59 an outlet aperture 60 and, in the region of the floor, an inlet aperture 61. Underneath the covering 58, the ventilation device 1 as well as a primary air installation 62 are accommodated. The latter comprises a primary air outlet 56 entering approximately in the region between the inlet aperture 61 and the heat exchanger 5 of the ventilation device 1.

During the operation of the installation according to FIG. 26, a revolving air mass comprising cold or warm vortices (cooling operation or heating operation) is generated in the room 2, which is induced by the air exiting from the air outlet aperture 60. That air rises to the ceiling of the room and travels in the direction towards the opposite wall 63. The air flow then drops again towards the floor and is eventually sucked into the inlet aperture 61. The primary air installation 61 may be represented by an air distributor box equipped with nozzles. The nozzles direct a propellant air current upwardly in the direction of the outlet aperture 60. The propellant air current may preferably take the form of an outside air current, in particular with a constant air temperature throughout the year.

The heat exchanger 5 of the above-described embodiments may be formed as a structure having an increased lamellae thickness and an increased lamellae spacing. This is made possible by the two-fold air passage (during the suction in and during the expulsion). A high heat transfer prevails. Only thin boundary layers are formed on the lamellae. Such heat exchangers are very easy to clean, there is only a little tendency for dirt to be deposited. It is also conceivable to provide a coating of dirt repellent varnish. Accordingly, the dust retention is low. This results in advantageously long maintenance intervals, and internal odor build-up is also avoided. In addition, it is also possible to provide only a small height for the lamellae because of the above-mentioned circumstances so that the dead volume is very small.

As illustrated in FIG. 26, a primary air installation 62 may be provided, so that the operation is not purely an air circulation, but fresh air is added. However, obviously it is also possible to provide no primary air installation 62 at all.

In FIG. 27, a gate air curtain installation 70 is shown comprising two ventilation devices 1 and comprising an air passage 71 provided above a gate opening which is not illustrated. This air passage 71 is provided on its underside 72 with outlet apertures 73 so that the air contained in the air passage 71 can emerge from these outlet apertures and form the gate air curtain. As is apparent from FIG. 28, the air passage 73 comprises three rows of outlet apertures 73, parallel to one another. It stands to reason that it is also possible to provide for example only one central row of outlet apertures 73.

In accordance with FIGS. 27 and 29 there is provided, above the air passage 71, in each of the ventilation devices 1, a chamber 6 of variable volume, which includes a heater means 74 in its air passage 21 which constitutes an air treatment apparatus 5'.

During the operation of the gate air curtain installation 70, air present in the region of the gate is sucked in by volume reduction (should be "volume enlargement"—translator's remark) of the chamber 6, in the course of which the air passes the heating means 74 and, thereafter, by volume reduction of the chambers 6 and a further passage through the heating means 74, is conducted into the air passage 71 and then emerges from the outlet apertures 73 to form the air curtain.

FIG. 30 represents an embodiment in which a ventilation device 1 is associated with an air duct 75 which on the upstream side includes air having a temperature $\sigma_E$. A heat exchanger 5 is installed in the wall of the air duct 75 and connects the latter to the chamber 6 of the ventilation device 1. The heat exchanger 5 is connected to a circulatory system 76 which serves to withdraw waste heat for appropriate desired purposes. During the operation, air present in the air duct 75 is sucked in at the temperature $\sigma_E$ and thereby passes the heat exchanger 5 in order to enter the chamber 6. During the expulsion of this air from the chamber 6 in the direction of the air duct 75, this air passes once again through the heat exchanger 5, with reduction of the temperature, and eventually it re-enters into the air duct 75, wherein it then on the downstream side has a temperature $\sigma_A$ which is lower than the temperature $\sigma_E$. This temperature reduction has resulted by heat having been given up to the heat exchanger 5 with the heat being passed to some point of use through the circulatory means 76.

FIG. 31 illustrates schematically a ventilation device 1 serving as a pure air conveyance installation, that is in the course of its air circulation operation, air is sucked in from a room 2 or a space zone 2' through the air passage 21, which merely forms an aperture, into the interior of the chamber 6 and is subsequently expelled again. This may, for example, serve to attain an effective mixing of the air in the room. A primary air component (or a flow admixture of optional type) may, in accordance with the embodiments of FIGS. 24, 25, 26, 35 and 36, be likewise provided for. An air treatment installation 5', as represented for example by the heat exchanger 5 mentioned in the aforesaid embodiments, is therefore not present in the embodiment according to FIG. 31.

The configuration of the wall 18 which constitutes a wall of the chamber 6 has an influence on the generation and the character of the expelled vortices. The geometry can be selected by the person skilled in the art in such a manner that expelled vortices of the desired type are produced.

As already mentioned above, the heat exchanger 5 represents an air treatment apparatus 5', which in the above-described embodiments was referred to by way of example. It is obviously possible to employ other types of air treatment apparatus 5' instead of the heat exchanger 5, for example, an apparatus of a kind which modifies the air humidity. It is also possible to employ material conversion installations, for example, catalysts which likewise would perform an air treatment.

Finally, it should be mentioned that in the illustrated in the Figures embodiments, it is also possible to employ ventilation devices 1 which do not comprise any air treatment apparatus 5', no heat exchanger 5 or the like.

In the embodiment according to FIG. 32, the air treatment apparatus 5' taking the form of a heat exchanger 5 is followed by a guide means 80 which includes, for example, a circular outlet aperture 81. It can be seen how from the outlet aperture 81 toroidal air vortices 82 are expelled. Altogether, essentially three components of the ventilation device 1 are thus provided, namely, the air conveyance installation (chamber 6, piston element 7), air treatment apparatus 5', and guide means 80. These components may also be supplied separately to be assembled at the site of use.

In FIG. 33, a pivotal element is provided instead of the linearly movable piston element 7 of FIG. 32.

The air guide means 80 permits to influence the nature and/or the direction of the exhaled vortices.

By means of the overall design it is, therefore, possible to influence the air flow in a room 2 or in a room zone 2'. If a certain comfort level is to be created, for example, in a living room, the procedure will be such that the vortices would not have too great an expulsion pulse or too great an expulsion velocity, so that, in accordance with FIG. 34, for example, cool vortices 83 are expelled between which a warm space air 84 is retained. As a result of the relatively low outlet velocity, a correspondingly high induction takes place such that as vortices are dissipated, a very effective air mixing is attained. Thus it is, for example, also possible without problems to provide effective ventilation with comfort in the corners of a room in order to create a pleasant climate. The ventilation method according to the invention is particularly advantageous as compared with the known blower ventilation because, in contrast to the blower ventilation, no Coanda effect along the confining walls, for example, at the ceiling and or partitioning walls takes place.

The invention is obviously and preferably also can be used in air conditioning, for example, in order to counteract the heat envelope, for example of a machine. In that case, vortices are expelled with a relatively high expulsion impulse and, therefore, with a high outlet velocity in order to, for example, counteract thermal conditions which may, for example be emitted by a textile or weaving machine. It is possible to break up this thermal field by means of the expulsion vortices generated by the installation according to the invention and thus to also provide optimal ventilation under such aggravated conditions. Such an effective ventilation result cannot be attained by means of the known blower ventilation as an air beam, because of the disturbance field, is very rapidly dissipated and/or deflected.

By the pulsating ventilation according to the invention, a very high heat exchange can be attained, which is approximately 30% higher than with conventional installations.

FIG. 35 illustrates an embodiment including a pivoting piston 7 where the chamber 6 is followed by a further chamber 85 into which a primary air connection 86 enters, preferably radially. The chamber 86 is preferably followed by the air treatment apparatus 5' which in turn is followed by guide means 80. FIG. 36 illustrates a corresponding embodiment including a linearly moving piston 7. In the working examples of FIGS. 35 and 36 it is, therefore, possible to admix primary air to the air conveyed in the air circulation mode, i.e., there takes place both a primary air as well as an air circulation operation. It is also possible to introduce additionally to or instead of the primary air any desired material flow, for example, air provided with fragrance additives or certain gases, etc.

Instead of the pivotal piston 7 or the linear piston 7 in the embodiments of FIGS. 35 and 36 or any of the pistons illustrated in other embodiments of the invention, it is, for example, also possible to employ a diaphragm or the like which is set into motion, i.e. into oscillation, by drive means, whereby a chamber is formed into which air is sucked and from which is expelled again. Such a diaphragm may, for example, also be oscillated electro-magnetically, "loudspeaker principle", which altogether results in the formation of an air propulsion installation.

We claim:

1. A ventilation device, comprising an air propulsion plant (20) for supplying a space zone with displacement air and including at least one variable volume chamber (6) for conveying at least a portion of the displacement air in an air circulating mode in a pulsating manner; and at least one air passage (21) for connecting the variable volume chamber with the space zone for effecting both sucking of air into the chamber from the space zone and for expulsion of substantially the same volume of air from the chamber into the space zone.

2. A ventilation device according to claim 1, characterized in that the air propulsion plant (20) generates, during expulsion of air, vortices having a rotational and translational impulse which is at least so high that they are separated and penetrate into the space zone (2').

3. A ventilation device according to claim 1, characterized in that the air propulsion plant (20) generates, during expulsion of air, a pulsating flow having high enough energy so that it is separated and penetrates into the space zone (2').

4. A ventilation device according to claim 1, characterized in that there is provided a drive device (9) for varying the volume of the chamber (6) and operating in a frequency range from 0.1 to 30 cycles/min.

5. A ventilation device according to claim 1, characterized by an air treatment apparatus (5') located in the air passage (21).

6. A ventilation device according to claim 5, characterized in that the air treatment apparatus (5') is formed as at least one of a heat exchanger (5), humidifying apparatus, and material transforming apparatus.

7. A ventilation device according to claim 1, characterized in that the air passage (21) is formed as an opening with an air treatment apparatus following it.

8. A ventilation device according to claim 1, characterized in that a piston element (7) is provided in the chamber (6) for varying a chamber volume.

9. A ventilation device according to claim 8, characterized in that the piston element (7) is formed as a translationally movable piston.

10. A ventilation device according to claim 8, characterized in that the piston element (7) is formed as a displacement element pivotable about an axis as a flap.

11. A ventilation device according to claim 1, characterized in that walls of the chamber (6) have a configuration corresponding to a displacement curve of a displacement element.

12. A ventilation device according to claim 8, characterized in that the piston element (7) is plate-shaped.

13. A ventilation device according to claim 8, characterized in that the piston element (7) has at least one of variable displacement speed, acceleration, a displacement length, and a displacement frequency adjustable to a predetermined value.

14. A ventilation device according to claim 8, characterized in that the piston element is formed as a displacement element having a variable pivoting angle adjustable to a predetermined value.

15. A ventilation device according to claim 5, characterized in that the chamber (6) has a base area larger than an adjoining base area of the air treatment apparatus (5').

16. A ventilation device according to claim 5, characterized in that the air treatment apparatus (5') has an air opening which is offset relative to a larger adjoining base area of the chamber (6) in a direction of a pivot axis (13) of a displacement element (14).

17. A ventilation device according to claim 16, characterized in that the air opening of the air treatment apparatus (5') adjoins the pivot axis (13).

18. A ventilation device according to claim 16, characterized in that the displacement element (14), in a pivotal movement reversal position thereof which occurs at an end of an expulsion phase, is located immediately adjacent to the air treatment apparatus (5').

19. An ventilation device according to claim 1, characterized in that a dead volume, that is a space volume which is not varied, is small in comparison with a maximum volume of the chamber (6).

20. A ventilation device according to claim 8, characterized in that the piston element (7) is separated from a wall of the chamber (6) by a gap (17).

21. A ventilation device according to claim 16, characterized in that the displacement element (14) has a pivot angle in a range from 20° to 180°.

22. A ventilation device according to claim 5, characterized in that one of the air passage (21) and an opening of the air treatment apparatus comprises air guide means (27).

23. A ventilation device according to claim 4, characterized in that the drive device (9) has at least one of a controllable frequency, displacement length, and pivot angle for adjusting intensity of air treatment.

24. A ventilation device according to claim 4, characterized in that the drive device (9) is formed as a motor having an eccentric device (111) engaging a piston element (7) provided in the chamber for varying the chamber volume.

25. A ventilation device according to claim 24, characterized in that the motor is a direct current electric motor.

26. A ventilation device according to claim 25, characterized in that the direct current motor is connected with an electric speed control device.

27. A ventilation device according to claim 4, characterized in that the drive device (9) is one of a lifting magnet drive and a rotary magnet drive.

28. A ventilation device according to claim 8, characterized in that the piston element (7) is associated with a return device (42).

29. A ventilation device according to claim 28, characterized in that the return device (42) comprises at least one return spring (43).

30. A ventilation device according to claim 8, characterized in that the piston element (7) is so arranged that gravity provides for the piston element attaining a return position thereof.

31. A ventilation device according to claim 8, characterized in that displacement of the piston element (7) is caused by one of a resonance frequency of the piston element and a resonance frequency of a system formed of a return device (42) and the piston element (7).

32. A ventilation device according to claim 8, characterized in that the air passage (21) is associated with each of two sides of the piston element (7), and the variable volume chamber (6) is associated with each of the two sides of the piston element (7).

33. A ventilation device according to claim 4, characterized in that the drive device is arranged outside of an air flow.

34. A ventilation device according to claim 1, characterized in that primary air delivery means cooperates with the chamber (6).

* * * * *